US010208516B2

(12) United States Patent
Miu et al.

(10) Patent No.: US 10,208,516 B2
(45) Date of Patent: Feb. 19, 2019

(54) DOOR CONTROL SYSTEM

(71) Applicant: WARREN INDUSTRIES LTD., Concord (CA)

(72) Inventors: Traian Miu, Oakville (CA); Mitchell English, Toronto (CA); Pasit Banjongpanith, Stouffville (CA); Douglas Broadhead, Brampton (CA)

(73) Assignee: WARREN INDUSTRIES LTD., Concord (CA)

( * ) Notice: Subject to any disclaimer, the term of this patent is extended or adjusted under 35 U.S.C. 154(b) by 0 days.

(21) Appl. No.: 16/000,537

(22) Filed: Jun. 5, 2018

(65) Prior Publication Data

US 2018/0283062 A1 Oct. 4, 2018

Related U.S. Application Data

(60) Division of application No. 15/893,183, filed on Feb. 9, 2018, now Pat. No. 10,041,281, which is a (Continued)

(51) Int. Cl.
*E05C 17/20* (2006.01)
*E05F 15/70* (2015.01)
(Continued)

(52) U.S. Cl.
CPC ..... *E05C 17/203* (2013.01); *E05C 17/006* (2013.01); *E05F 15/622* (2015.01); (Continued)

(58) Field of Classification Search
CPC .... E05C 17/203; E05C 17/006; E05C 17/003; E05F 15/70; E05F 15/622; E05F 15/43; E05F 15/73; E05F 15/60; E05F 15/611; E05F 2015/483; E05F 5/06; Y10T 16/61; Y10T 16/629; Y10T 16/625; E05Y 2900/531
See application file for complete search history.

(56) References Cited

U.S. PATENT DOCUMENTS 6,744,365 B2 * 6/2004 Sicuranza ..... E05C 17/00 250/221
6,842,943 B2 * 1/2005 Hoffmann ..... E05C 17/203 16/50

(Continued)

*Primary Examiner* — Justin B Rephann
(74) *Attorney, Agent, or Firm* — Millman IP Inc.

(57) ABSTRACT

In an aspect, a door control system is provided for a vehicle door and includes a pushrod and a locking device. The pushrod has a first end connected to one of the vehicle body and the vehicle door. At least a portion of the locking device is mounted to the other of the vehicle body and the vehicle door. The locking device includes a leadscrew, a leadscrew nut mounted on the leadscrew, a housing including a guide path, and a brake. The pushrod has a second end connected to the leadscrew nut. The leadscrew nut is constrained against rotation but is slideable along the guide path by movement of the pushrod, which causes rotation of the leadscrew. The brake is positionable in a braking position in which the brake prevents rotation of the leadscrew, and a release position in which the brake permits rotation of the leadscrew.

11 Claims, 33 Drawing Sheets

Related U.S. Application Data continuation of application No. 15/829,390, filed on Dec. 1, 2017.

(60) Provisional application No. 62/429,028, filed on Dec. 1, 2016.

(51) Int. Cl.
*E05F 15/622* (2015.01)
*E05C 17/00* (2006.01)

(52) U.S. Cl.
CPC ..... *E05F 15/70* (2015.01); *E05Y 2900/531* (2013.01); *Y10T 16/61* (2015.01)

(56) References Cited

U.S. PATENT DOCUMENTS 6,901,630 B2 * 6/2005 Liang ..... E05C 17/203 16/82
7,500,711 B1 * 3/2009 Ewing ..... E05F 15/622 296/146.1
2008/0294314 A1 * 11/2008 Morris ..... E05F 5/00 701/49
2009/0217596 A1 * 9/2009 Neundorf ..... E05B 81/20 49/506
2010/0154163 A1 * 6/2010 Hoffmann ..... E05C 17/203 16/85
2011/0061200 A1 * 3/2011 Rauscher ..... E05C 17/203 16/337
2011/0266080 A1 * 11/2011 Schmitt ..... E05C 17/006 180/89.1
2013/0074412 A1 * 3/2013 Wellborn ..... E05C 17/203 49/381
2014/0083226 A1 * 3/2014 Sakai ..... E05F 3/16 74/473.25
2014/0137474 A1 * 5/2014 Suzuki ..... E05F 15/611 49/31
2015/0267444 A1 * 9/2015 Neag ..... E05C 17/203 16/82
2015/0283886 A1 * 10/2015 Nania ..... E05F 15/73 296/146.4
2016/0348413 A1 * 12/2016 Broadhead ..... E05F 15/73
2017/0284142 A1 * 10/2017 Jaranson ..... E05C 17/203
2017/0328097 A1 * 11/2017 Gruber ..... E05C 17/006

* cited by examiner

DOOR CONTROL SYSTEM

CROSS-REFERENCE TO RELATED APPLICATIONS

This application is a divisional of and claims the benefit of U.S. Ser. No. 15/893,183, which is a continuation of and claims the benefit of U.S. Ser. No. 15/829,390 filed on Dec. 1, 2017, which claims the benefit of U.S. Provisional Patent application 62/429,028 filed Dec. 1, 2016, the contents of both of which are incorporated herein in their entirety.

FIELD

This disclosure relates generally to vehicle door check systems and more particularly to door check systems that permit a user to select a position at which a door is to be checked.

BACKGROUND

Vehicle doors are typically swung between fully closed and fully opened positions to permit ingress and egress of passengers to and from a vehicle. A door check system is typically employed to provide one or more intermediate holding positions for the door for convenience. Traditional door check systems suffer from a number of deficiencies, however. For example, the intermediate positions provided by the door check system can sometimes be inconvenient in the sense that they either don't give a vehicle user sufficient room to enter or leave the vehicle, or they are positioned so far outward that the door is at risk of hitting a door from an adjacent parked vehicle (e.g. in a mall parking lot).

The patent literature contains some proposed door check systems that permit infinite adjustability in terms of selecting an intermediate position at which to hold the door between the fully open and fully closed position. Such systems are, in some instances, complex, prone to failure due to contamination with debris, and can be large, intruding significantly on the already restricted amount of space available inside a vehicle door. It would be beneficial to provide a door check system that at least partially addresses one or more of the problems described above or other problems associated with door check systems of the prior art.

SUMMARY OF THE DISCLOSURE

In an aspect, a vehicle door control system is provided for a vehicle having a vehicle body and a vehicle door. The vehicle door control system includes a pushrod and a locking device. The pushrod has a first end that is connected to one of the vehicle body and the vehicle door. At least a portion of the locking device is mounted to the other of the vehicle body and the vehicle door. The locking device includes a locking device leadscrew, a locking device leadscrew nut mounted on the locking device leadscrew, a locking device housing including a locking device leadscrew nut guide path, and a locking device leadscrew brake. The pushrod has a second end that is connected to the locking device leadscrew nut. The locking device leadscrew nut is constrained against rotation but is slideable along the locking device leadscrew nut guide path by movement of the pushrod, which causes rotation of the locking device leadscrew. The locking device leadscrew brake is positionable in a braking position in which the locking device leadscrew brake prevents rotation of the locking device leadscrew, and a release position in which the locking device leadscrew brake permits rotation of the locking device leadscrew. The locking device leadscrew brake includes a plurality of plates which are interleaved with a plurality of discs. The plurality of plates are non-rotatable relative to the housing but are translatable relative to the housing. The plurality of discs are connected to the leadscrew. The locking device leadscrew brake further includes a motor having a motor output shaft that is rotatable in a first direction to increase compression of the plates and the discs so as to increase a frictional force that prevents rotation of the leadscrew. The motor output shaft is rotatable in the second direction to reduce compression of the plates and the discs, so as to decrease the frictional force that prevents rotation of the leadscrew. The motor is controllable to modulate the frictional force that prevents rotation of the leadscrew.

In another aspect, a vehicle door control system is provided for a vehicle having a vehicle body and a vehicle door. The vehicle door control system includes a check arm having a first end that is connected to one of the vehicle body and the vehicle door, and a check arm keeper. At least a portion of the check arm keeper is mounted to the other of the vehicle body and the vehicle door. The check arm keeper includes at least one plunger having a plunger cam surface, a plunger drive cam having a plunger drive camming surface that is engaged with the plunger cam surface. Rotation of the plunger drive cam in a first rotational direction increases a brake force applied by the at least one plunger on the check arm, and rotation of the plunger drive cam in a second rotational direction decreases a brake force applied by the at least one plunger on the check arm.

In another aspect, a vehicle door control system is provided for a vehicle having a vehicle body and a vehicle door. The vehicle door control system includes a pushrod, a locking device, a motor, a controller and a door force sensor. The pushrod has a first end that is connected to one of the vehicle body and the vehicle door. At least a portion of the locking device is mounted to the other of the vehicle body and the vehicle door. The locking device includes a locking device traveler that is movable along a locking device traveler guide path, and a locking device brake. The pushrod has a second end that is connected to the locking device traveler. The locking device traveler is movable along the locking device traveler guide path by movement of the pushrod. The locking device brake is positionable in a braking position in which the locking device brake prevents movement of the locking device traveler, and a release position in which the locking device brake permits movement of the locking device traveler. The motor is operable to move the locking device brake between the braking and release positions. The controller controls operation of the motor. The door force sensor includes a first target path, and a second target path, and a first target that is connected to a first portion of the locking device traveler and movable along the first target path and a second target that is connected to a second portion of the locking device leadscrew nut and movable along the second target path. The first portion of the locking device traveler is constrained for movement along a traveler path, and the second portion of the locking device traveler is movable relative to the first portion of the locking device traveler and is operatively connected to the first portion of the locking device traveler via a traveler spring. The second end of the pushrod is connected to the second portion of the locking device traveler. The first target is connected for movement with the first portion of the locking device traveler and the second target is connected for movement with the second portion of the locking device traveler. When the locking device brake is positioned in the braking position, movement of the vehicle door drives relative movement between the first portion of the locking device traveler and the second portion of the locking device traveler via the pushrod, so as to generate relative movement between the first target and the second target. The door force sensor is connected to the controller so as to send signals to the controller that are indicative of the positions of the first and second targets. The controller is programmed to control operation of the motor based at least in part on a difference in the positions of the first and second targets relative to one another.

BRIEF DESCRIPTION OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
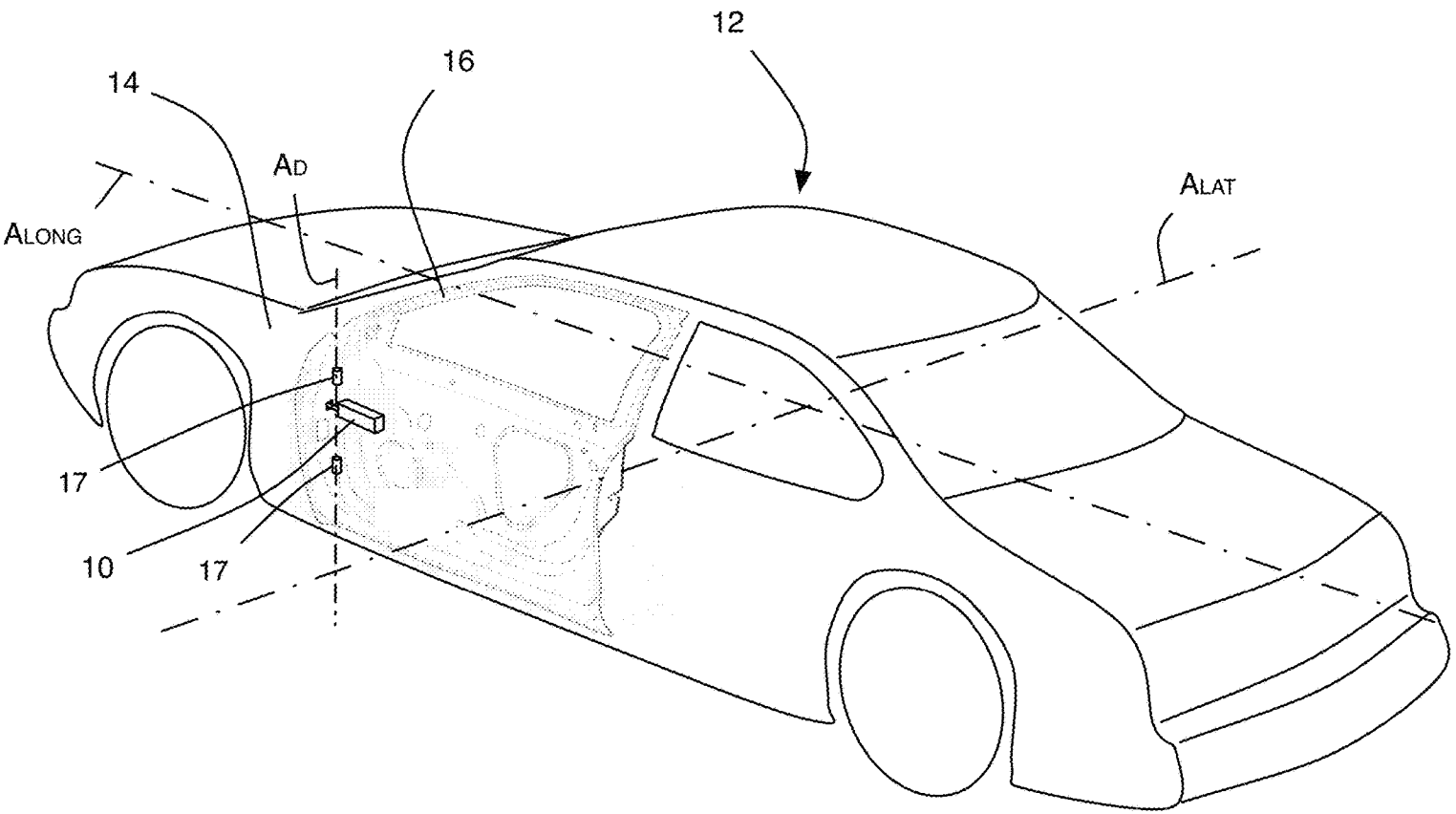
FIG. 1 is a perspective view of a vehicle with a vehicle door and a vehicle door control system in accordance with an embodiment of the present disclosure.

Reference is made to FIG. 1, which shows a vehicle door control system 10 for a vehicle 12 having a vehicle body 14 and a vehicle door 16 pivotally mounted to the body 14 by way of hinges 17 for pivoting movement about a door pivot axis $A_D$, in accordance with an embodiment of the present disclosure. The vehicle 12 has a longitudinal axis $A_{LONG}$ and a lateral axis $A_{LAT}$.

In some embodiments, the vehicle door control system 10 can check the door 16 in a user-selectable position somewhere in a range of door movement between a fully open position and a fully closed position. In some embodiments, the door control system 10 can check the door 16 anywhere within the aforementioned range of movement, providing infinite door check capability. In other embodiments, the door control system 10 can check the door 16 in a user-selected position selected from amongst one or more discrete positions within the aforementioned range of movement.

Figure 2:
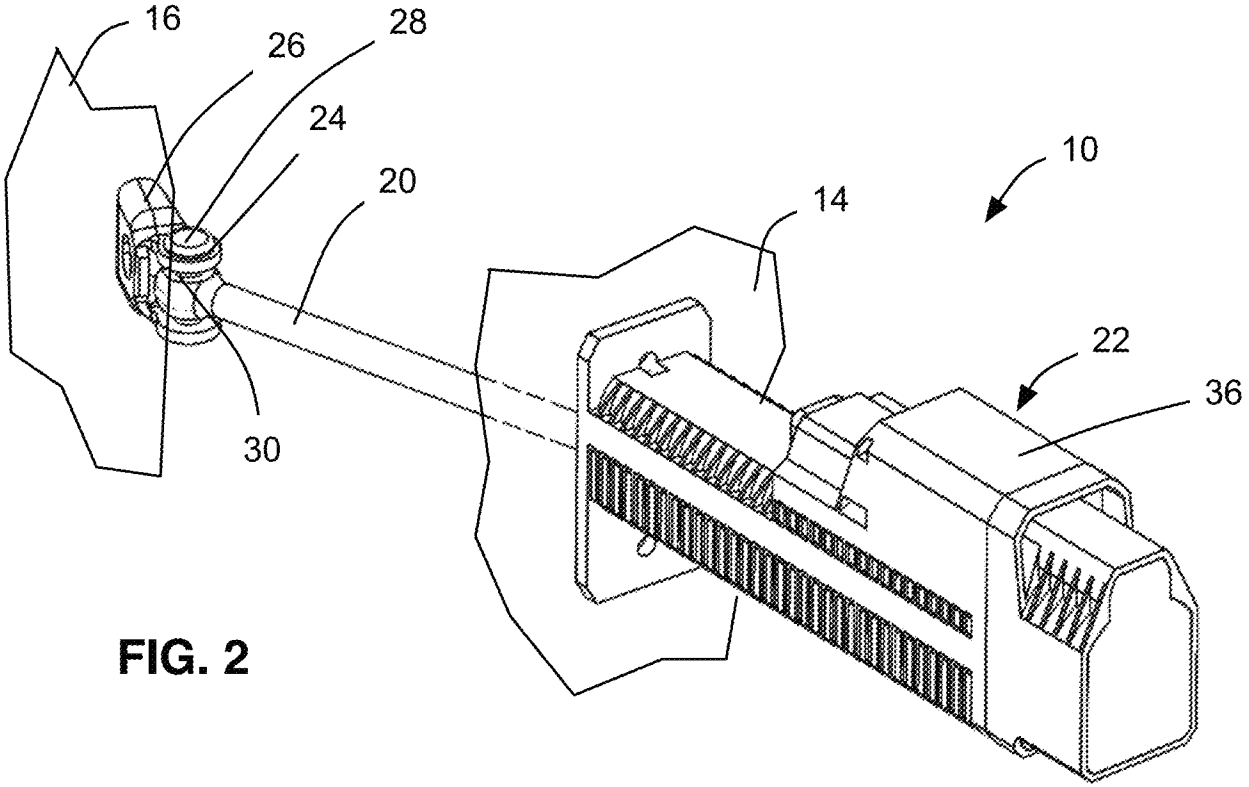
FIG. 2 is a perspective view of the vehicle door control system shown in FIG. 1.

Referring to FIG. 2, the door control system 10 includes a pushrod 20 and a locking device 22. The pushrod 20 has a first end 24 that is connected to one of the vehicle body 14 and the vehicle door 16. In the embodiment shown, the first end 24 is pivotally connected to the vehicle body 16 by means of a mounting bracket 26 mounted to the vehicle body 16 that holds a pin 28 that passes through an aperture 30 at the first end 24 of the pushrod 20.

Figure 3:
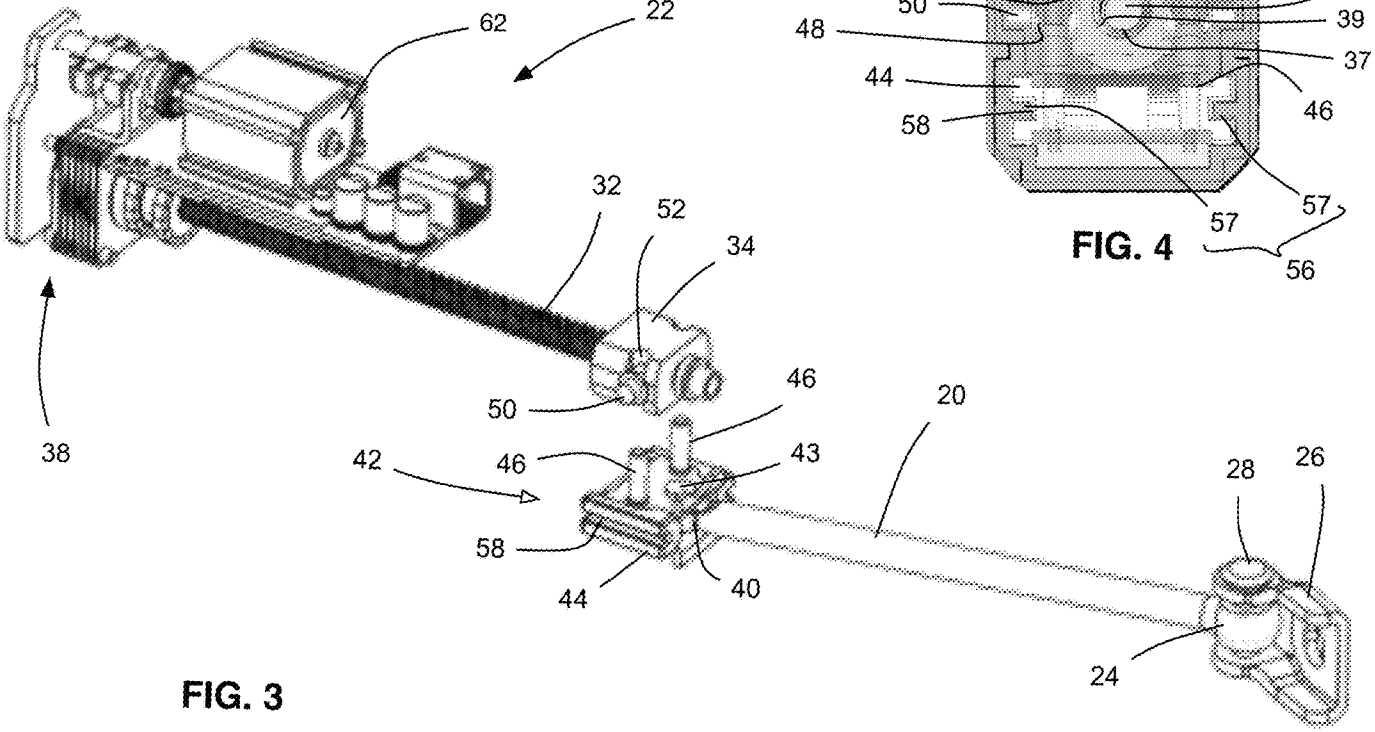
FIG. 3 is an exploded perspective view of the vehicle door control system shown in FIG. 2, with certain components removed for greater clarity.

Referring to FIG. 3, the locking device 22 includes a locking device leadscrew 32, a locking device leadscrew nut 34, a locking device housing 36 (FIG. 2), and a locking device leadscrew brake 38.

The locking device leadscrew nut 34 is mounted on the locking device leadscrew 32 as is typical of a nut on a leadscrew. In the embodiment shown, the locking device leadscrew 32 has an external leadscrew thread shown at 37 (FIG. 4), while the locking device leadscrew nut 34 has an internal leadscrew nut thread 39 that mates with the external leadscrew thread 37.

The pushrod 20 has a second end 40 that is connected to the locking device leadscrew nut 34 at least indirectly. In the example shown in FIG. 3, a connection between the pushrod and the leadscrew nut is shown at 42. The connection 42 includes some tolerance for misalignment in several places. For example, an intermediate member 44 is provided, which is pivotally connected (via pin connection 43) to the second end 40 of the pushrod 20. The intermediate member 44 itself has pins 46 that extend into receptacles 48 (FIG. 4) in lateral arm pins 50 which extend from slots 52 (FIG. 3) on either side of the of leadscrew nut 34. The lateral arm pins 50 extend into a locking device leadscrew nut guide path 54 that is included in the housing 36. In the example shown the guide path 54 is formed by slots 55 in the housing 36 that run parallel to the axis of the leadscrew 32. The intermediate member 44 itself engages an intermediate member guide path 56 that is included in the housing 36. The guide path 56 may be formed by a pair of projections 57 extending into slots 58 in the intermediate member 44, which runs parallel to the axis of the leadscrew 32.

By providing the connection 42, the locking device 22 is tolerant of several types of misalignment that can occur between the positions of the second end 40 of the pushrod 20 and the leadscrew nut 34. Such misalignment could otherwise cause the nut 34 to jam on the leadscrew 32 thereby preventing movement of the hub 34 on the leadscrew 32, which would prevent opening or closing of the vehicle door 14.

The locking device leadscrew nut 34 is constrained against rotation (by virtue of the engagement of the arm pins 50 with the slots 55 but is slideable along the locking device leadscrew nut guide path 54 by movement of the pushrod 20. Movement (i.e. translation) of the nut 34 along the leadscrew 32 causes rotation of the locking device leadscrew 32.

Figure 5:
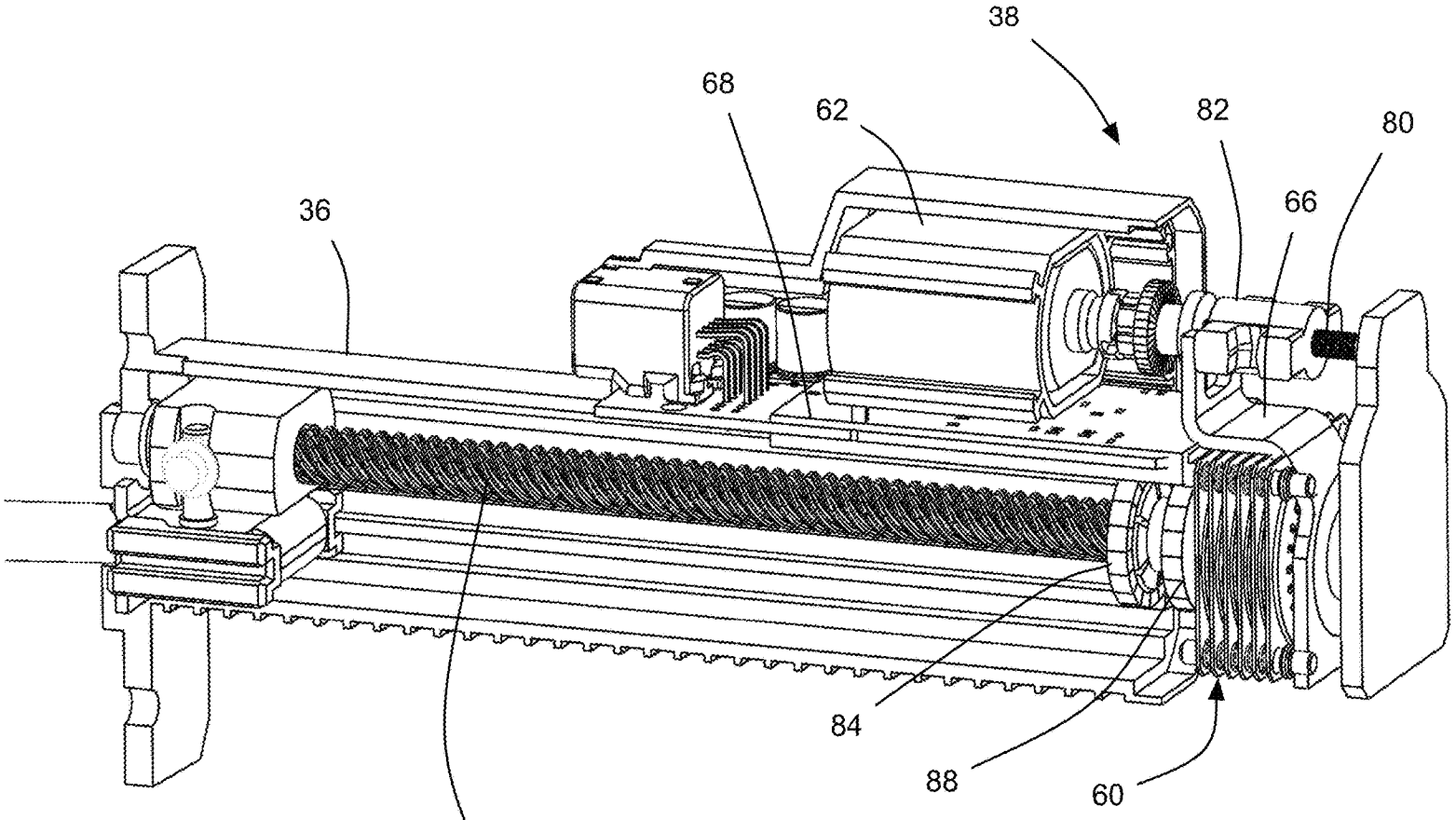
FIG. 5 is a perspective cutaway view of the vehicle door control system shown in FIG. 2, in a release position.
Figure 6:
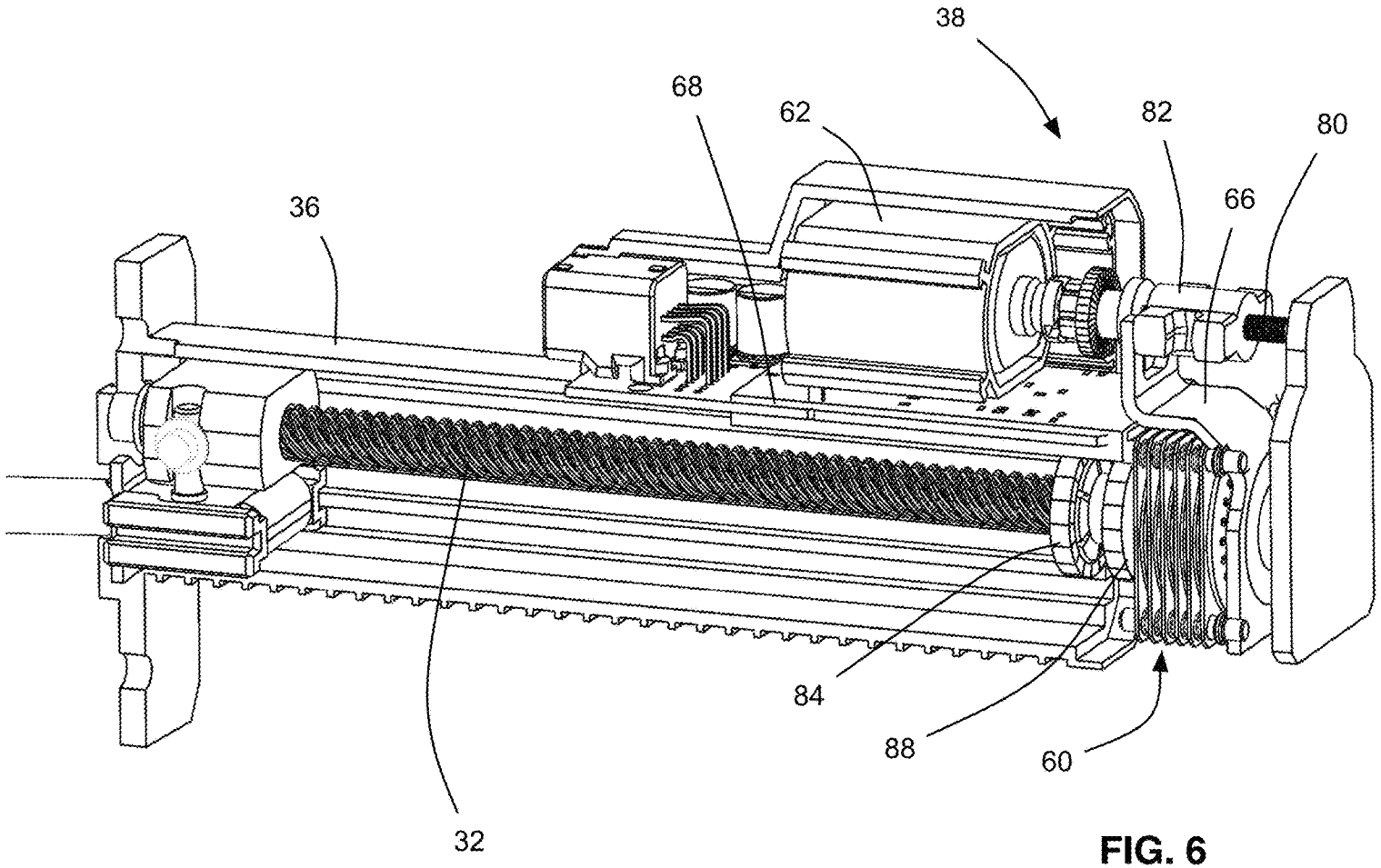
FIG. 6 is a perspective cutaway view of the vehicle door control system shown in FIG. 2, in a braking position.

The locking device leadscrew brake 38 is positionable in a braking position in which the locking device leadscrew brake 38 prevents rotation of the locking device leadscrew 32 (FIG. 6), and a release position in which the locking device leadscrew brake 38 permits rotation of the locking device leadscrew 32 (FIG. 5). The brake 38 may include a clutch pack 60, a motor 62, a clutch pack compression member 66 that is movable by the motor 62 to selectively compress the clutch pack 50 to prevent rotation of the locking device leadscrew 32, and a controller 68.

Figure 7:
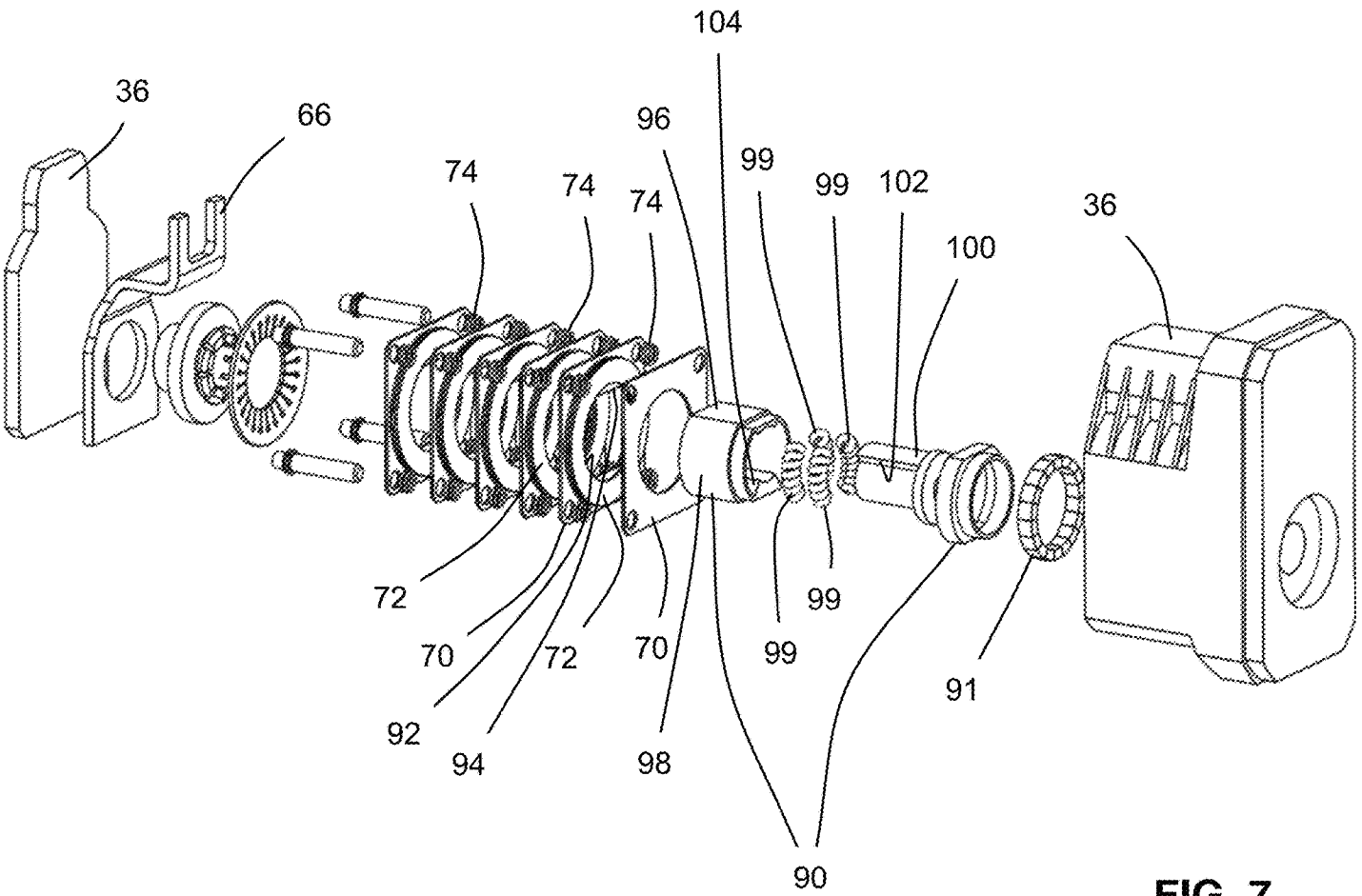
FIG. 7 is an exploded perspective view of a clutch pack that is part of a brake for the vehicle door control system shown in FIG. 2.

Referring to FIG. 7, the clutch pack 60 includes a plurality of clutch plates 70 interleaved with a plurality of clutch discs 72. The clutch plates 70 are non-rotatable due to their square exterior shape and engagement with the inner wall of the housing 36. The clutch discs 72 are operatively connected to the leadscrew 32. Spacer springs 74 may be provided to ensure that the clutch plates 70 spread apart when the compression member 66 is moved to a position of non-compression shown in FIG. 5. xx When the clutch pack 60 is compressed (FIG. 6) by the compression member 66, the clutch discs 72 are prevented from rotating, thereby preventing the leadscrew 32 from rotating, thereby holding the vehicle door 14 in a particular position. When the clutch pack 60 is uncompressed (FIG. 5), the clutch discs 72 are permitted to rotate, thereby permitting the leadscrew 32 to rotate, thereby permitting the vehicle door 14 to be moved. It will be noted that the amount of compression applied to the clutch pack 60 controls the amount of resistive (frictional) force is applied between the clutch plates 70 and clutch discs 72. Thus, by selecting the amount of compression that is applied, the check force on the vehicle door 14 can be modulated. This permits the check force on the vehicle door 14 to be applied at a selected ramp rate, for example, if it is desired to slow down the door in a progressive manner, rather than stopping it abruptly.

The motor 62 has a motor output shaft 69 which has a motor leadscrew 80 mounted thereon. Thus, the motor 62 is operatively connected to a motor leadscrew 80. The motor leadscrew 80 has a motor leadscrew nut 82 thereon. The motor leadscrew nut 82 is constrained against rotation by any suitable means, such as by the housing 36, or by its engagement with the clutch pack compression member 66, but is translatable along a motor leadscrew nut path by rotation of the motor 62. The connection of the motor leadscrew nut 82 to the clutch pack compression member 66 operatively connects the motor 62 to the clutch pack compression member 66.

Rotation of the motor 62 to draw the nut 82 and therefore the clutch pack compression member 66 inwardly causes compression of the clutch pack 60, so as to increase the brake force applied on the leadscrew 32 and therefore increasing the check force applied on the vehicle door 14.

Rotation of the motor 62 to push the nut 82 and therefore the clutch pack compression member 66 outwardly reduces compression of the clutch pack 60, so as to decrease the brake force applied on the leadscrew 32 and therefore decreasing the check force applied on the vehicle door 14.

The controller 68 controls operation of the motor 62. The controller 68 may receive signals from other controllers within the vehicle 12, or may operate substantially independently of any other controllers. The controller 68 may receive signals from one or more sensors to determine actions to take. For example, a door position sensor 84 may be provided to indicate to the controller 68 the position of the door 14. The door position sensor 84 may be, for example, a Hall effect sensor mounted to the circuit board of the controller 68, and positioned to detect a series of magnets 86 provided on the periphery of a disc on one end of the leadscrew 32. The controller 68 may count the number of rotations of the leadscrew 32 away from a home position when the vehicle door 14 is closed in order to determine a current position of the door 14. The number of magnets over the circumference of the disc on the leadscrew 32, the resolution of the sensor 84 determines the resolution of the sensor 84. This can be any suitable selected value. The door movement sensor 84 is also usable to determine the speed at which the door 14 is moving. The controller 62 can use this information to determine how much braking force to apply via the clutch pack 60 so as to control the speed of the door 14.

When the brake 38 is in the braking position (FIG. 5) the controller 62 may use any suitable means for determining when it is appropriate to release the check force on the door 14 to permit a user to move the door 14. For example, the controller 62 may be configured to determine how much force the user is applying (referred to as an initiation force) to the door 14 to move the door away from a particular position. If the controller 62 determines that the user has applied at least a selected initiation force the controller 62 may be programmed to release the check force on the door 14 either partially or fully, by controlling the motor 62 to move the compression member 66 to a selected position.

Figure 8:
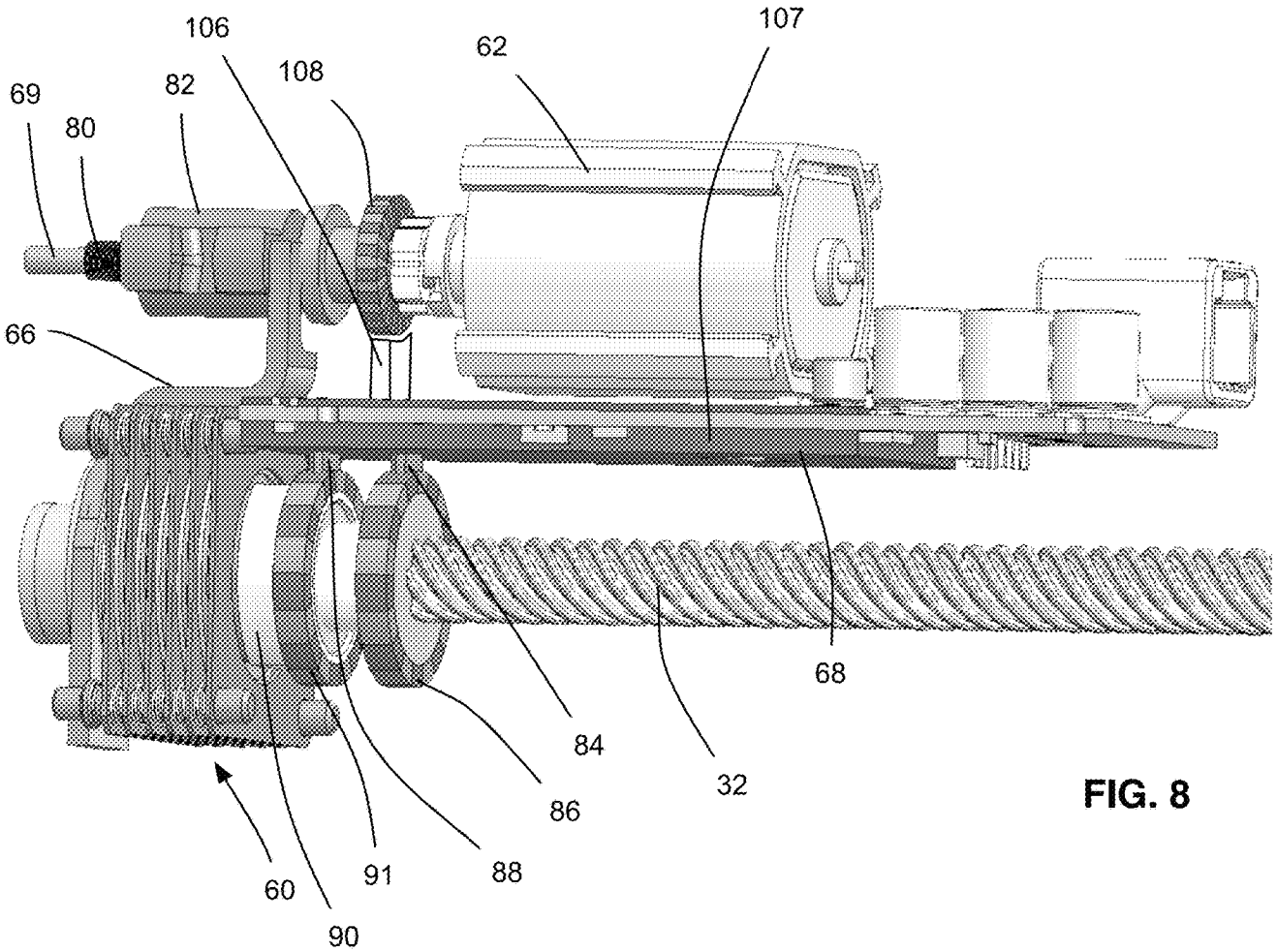
FIG. 8 is a perspective view of the clutch pack shown in FIG. 7.
Figure 9:
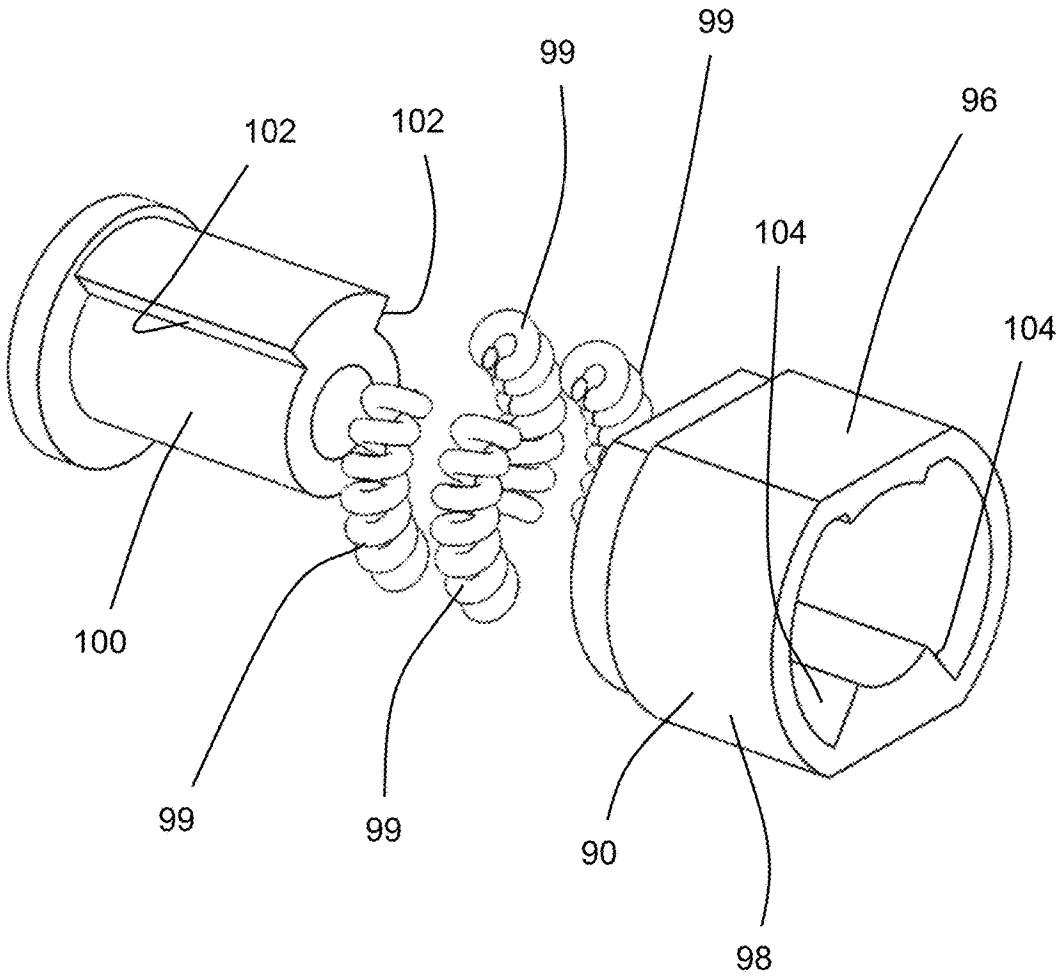
FIG. 9 is an exploded perspective view of a force transfer structure that is part of the vehicle door control system shown in FIG. 2 incorporating force transfer springs.

To determine the amount of force being applied to the door 14 by the user, the door control system 10 may employ a door force sensor shown at 88. The door force sensor 88 may be another Hall effect sensor mounted to the aforementioned circuit board and positioned to detect the rotational position of a leadscrew output member 90 (FIG. 7) via detection of magnets 91 on the output member 90. The leadscrew output member 90 is directly engaged with the clutch discs 82. In the example shown the clutch discs 82 each have an aperture 92 with a first flat 94 that engages a second flat 96 on the outer surface 98 of the output member 90. The leadscrew output member 90 is engaged with the leadscrew 32 via at least one force transfer spring 99 (FIG. 9). In the example shown, there are four force transfer springs 99. In the example shown, the leadscrew 32 has an extension member 100 that has a first force transfer surface 102 that engages a first end of each of the springs 99. The leadscrew output member 90 has a second force transfer surface 104 that engages a second end of each of the springs 99. Because of the presence of the at least one force transfer spring 99, when a force is applied to the door 14, there will be some small amount of rotation of the leadscrew 32 (FIG. 8) relative to the leadscrew output member 90. This movement is detectable by the controller 68 by comparing signals from the door movement sensor 84 and the door force sensor 88. For example, when the clutch pack is clamped hard no movement will be detected by the door force sensor, but a selected angular movement may be detected through the door movement sensor 84 when the user applies some amount of force on the door 14. If the relative angular movement detected is sufficiently large, the controller 68 may determine that the user has applied a sufficiently high initiation force and the controller 68 may command the motor 62 to reduce (optionally reduce to zero) the check force on the door.

Optionally, a compression member position sensor 106 (FIG. 8) is provided, that is mounted to the aforementioned circuit board (shown at 107) and is positioned to determine the position of the compression member, which may be used to determine the amount of brake force is being applied via the clutch pack 60 and therefore the amount of check force being applied on the door 14. The compression member position sensor 106 may be a Hall effect sensor that is positioned to detect magnets 108 provided on a disc on the motor output shaft 69. The controller 68 may receive signals from the compression member position sensor 106 and may determine how to drive the motor 62 to provide a selected brake force based at least in part on these signals. The compression member position sensor 106 may also be referred to as a check force sensor.

An advantage of the door control system 10 is that is has essentially a fixed volumetric footprint, in the sense that there are no parts that move and sweep through space outside of the housing 36. This is advantageous over typical door checks that rely on a check arm that moves through the check arm keeper, in that the present system 10 occupies less space in the door where the space available for other components can be relatively small. Typically engineers must provide a greater amount of clearance around elements in a door that move, whereas elements that have a housing that do not move may be permitted to be positioned closer to other components in the door.

Figure 10:
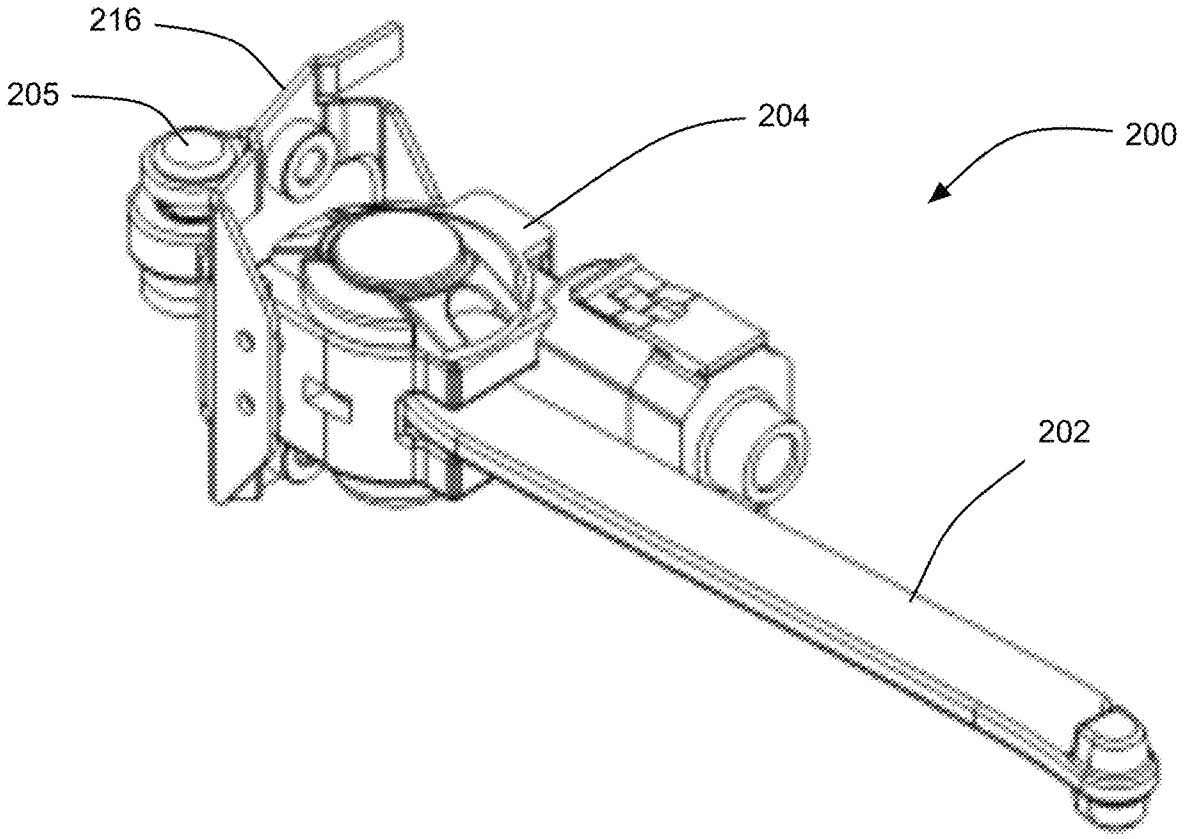
FIG. 10 is a perspective view of a door control system in accordance with another embodiment of the present disclosure.
Figure 11:
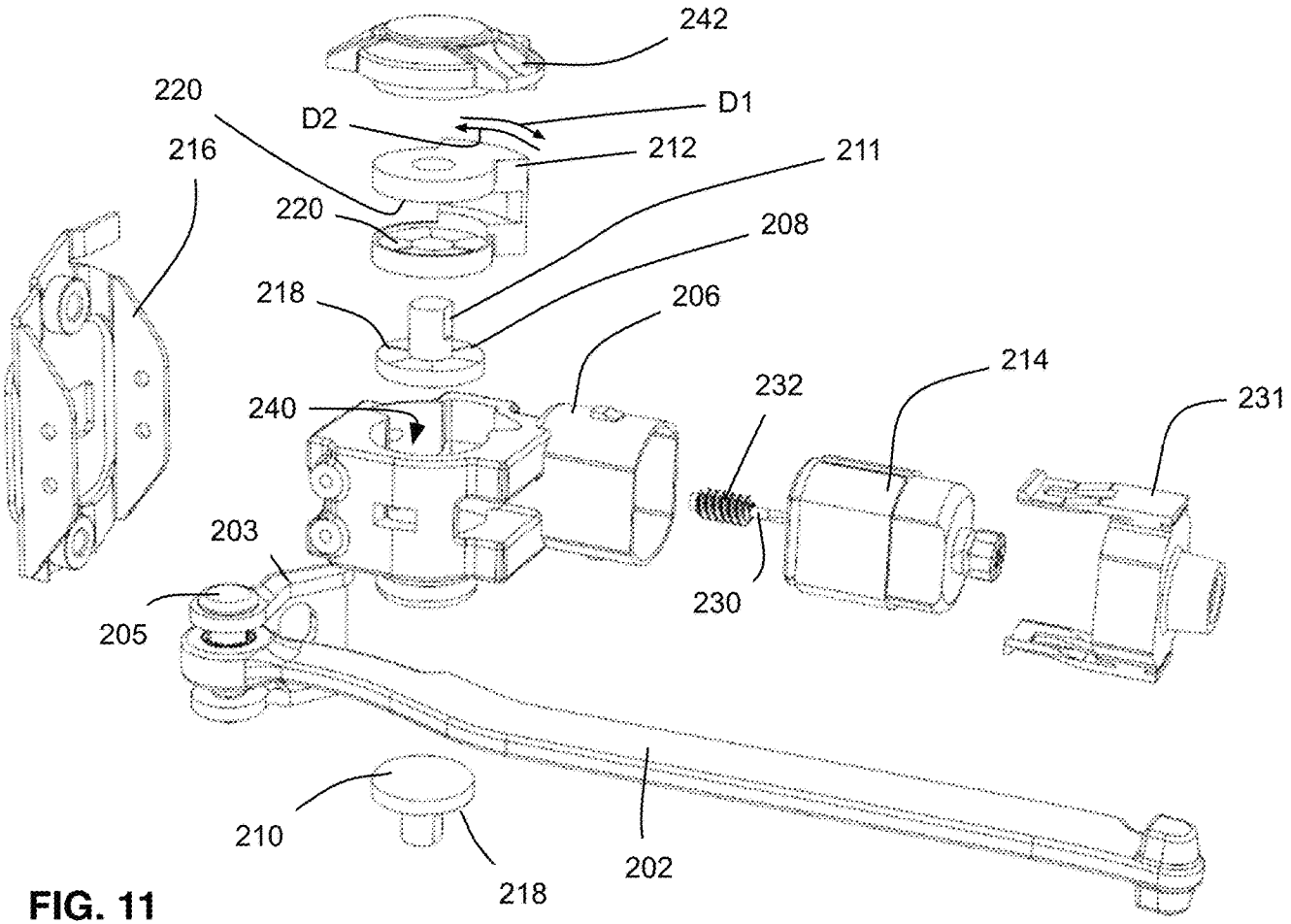
FIG. 11 is an exploded perspective view of the door control system shown in FIG. 10.

Reference is made to FIG. 10, which shows a door control system 200 in accordance with another embodiment of the present disclosure. The door control system 200 includes a check arm 202 and a check arm keeper 204. The check arm 202 has a first end 206 that is mountable (e.g. pivotally mountable) to one of the vehicle door 14 and the vehicle body 16, optionally using a bracket 203 and pin 205 that are similar to the bracket 20 and the pin 28 shown in FIGS. 1 and 2. The check arm 202 has a stop 207 thereon to prevent withdrawal from the check arm keeper 204. Referring to FIG. 11, the check arm keeper 204 is mounted to the other of the vehicle door 14 and the vehicle body 16. The check arm keeper 204 includes a check arm keeper housing 206, a first plunger 208, an optional second plunger 210, a plunger drive cam 212 and a drive cam actuator 214. The check arm keeper housing 206 may be fixedly mounted to said other of the vehicle door 14 and the vehicle body 16 via a mounting bracket 216. In the example shown, the check arm 202 is mounted to the vehicle body 16 and the check arm keeper 204 is mounted to the vehicle door 14.

Figure 13:
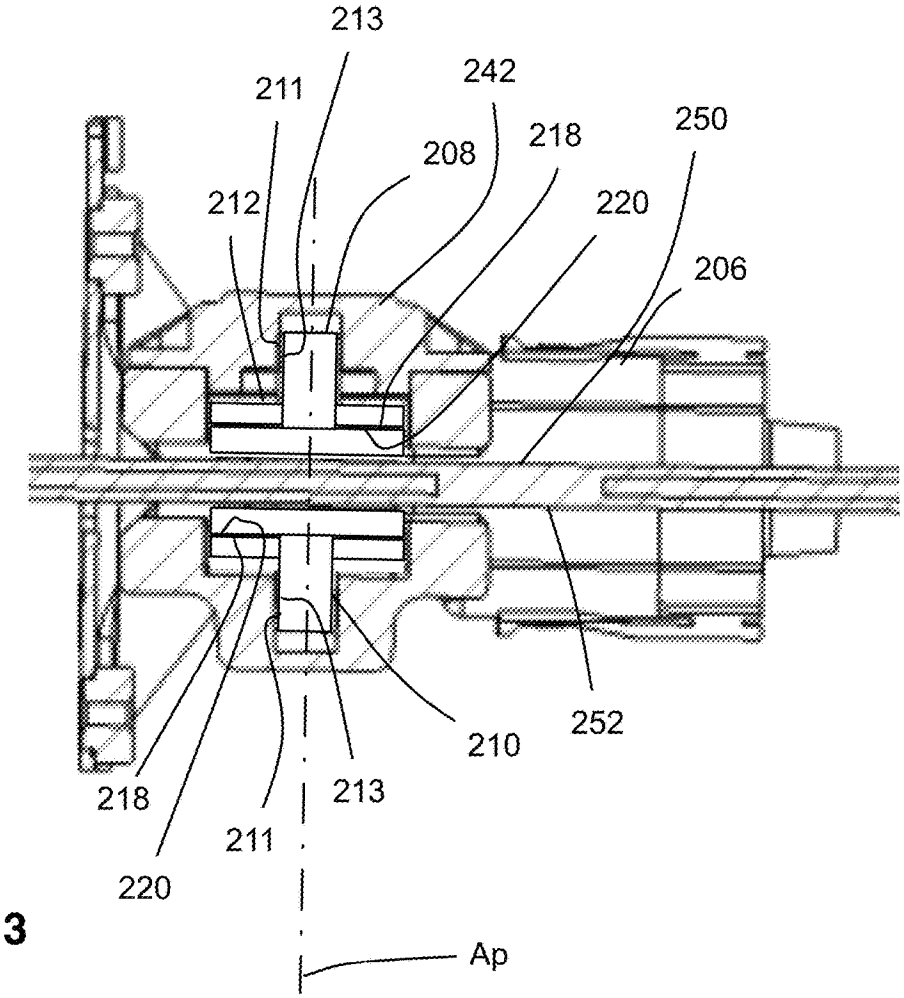
FIG. 13 is a sectional side elevation view of the door control system shown in FIG. 10, in a fully braked position.
Figure 14:
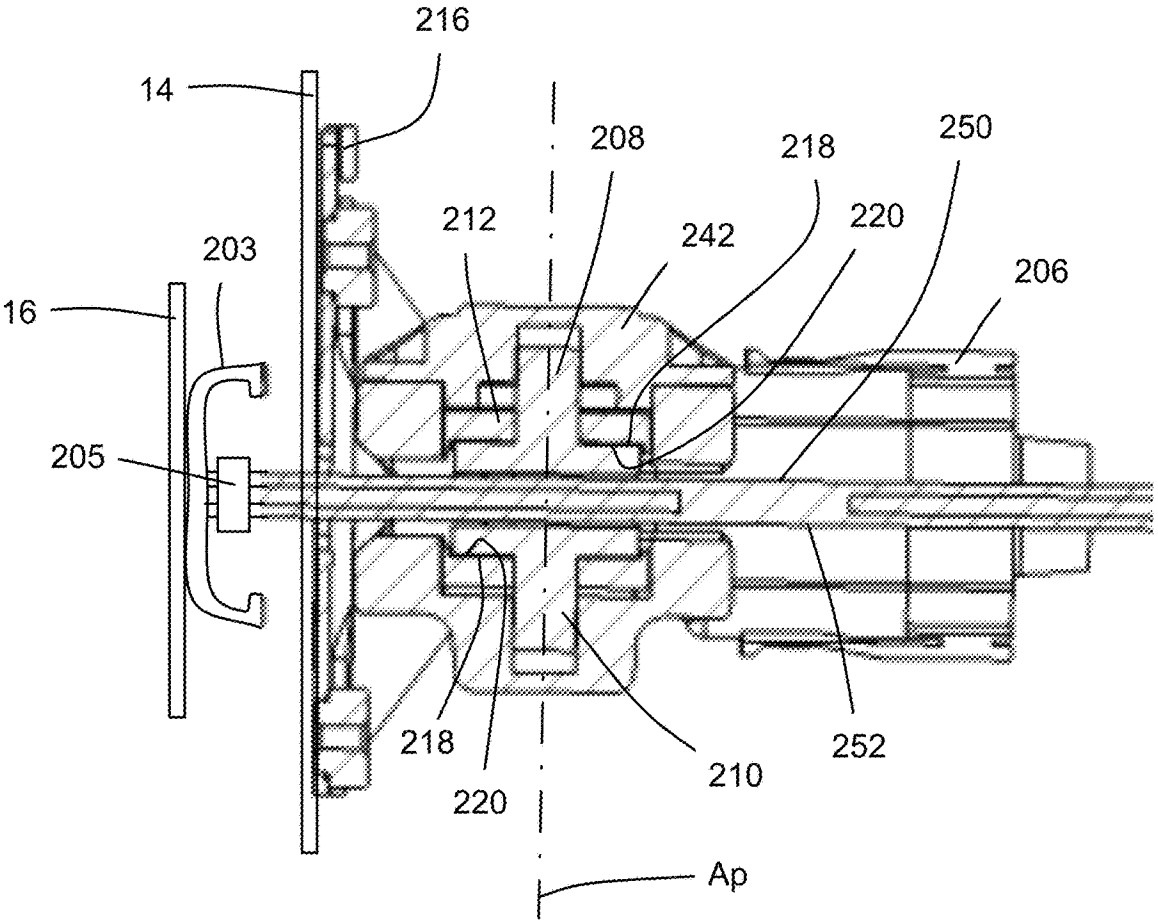
FIG. 14 is a sectional side elevation view of the door control system shown in FIG. 10, in a release position.

The first and second plungers 208 and 210 are movable along a plunger axis Ap (FIGS. 13 and 14) between a fully braked position (FIG. 13) and a release position (FIG. 14). The plungers 208 and 210 are translatable along the axis Ap, but are not rotatable, due to engagement of a flat 211 on each plunger 208 and 210 with an adjacent flat 213 on the housing 206 that connects fixedly to the housing 206. In the fully braked position, the plungers 208 and 210 apply a brake force to the check arm 202, which holds the door 14 in position. In the release position, the plungers 208 and 210 are not driven into the check arm 202 (and may be spaced from the check arm 202) so as to permit the door 14 to move freely.

The first and second plungers 208 and 210 each have a plunger cam surface 218 thereon. The plunger drive cam 212 has a plunger drive camming surface 220 thereon adjacent each plunger cam surface 218. The plunger drive cam 212 is rotatable in a first rotational direction D1 (FIGS. 11 and 12) to cause camming surfaces 220 to drive against plunger cam surfaces 218 to cause plungers 208 and 210 to move towards the check arm 202 and to apply a progressively increasing brake force on the check arm 202. Continued rotation of the plunger drive cam 212 in the first rotational direction increases the brake force on the check arm 202. Rotation away from the fully braked position in a second rotational direction D2 causes progressive reduction of the brake force on the check arm 202 by the plungers 208 and 210. It will be noted that the first plunger 208 is engageable with a first side 250 (FIGS. 13 and 14) of the check arm 202, and the second plunger 210 is engageable with a second side 252 of the check arm 202 that is opposite the first side 250.

The motor 214 is used to drive the plunger drive cam 212 in the first and second rotational directions. To this end, the motor 214 has a motor output shaft 230 on which there is a worm 232. The worm 232 engages a sector gear 234 (FIG. 12) that is on the plunger drive cam 212. Rotation of the motor output shaft 230 in a first direction causes rotation of the plunger drive cam 212 in the first rotational direction D1. Rotation of the motor output shaft in a second direction causes rotation of the plunger drive cam 212 in the second rotational direction D2. A motor mounting bracket 231 may be provided to help hold the motor to the housing 206.

Figure 12:
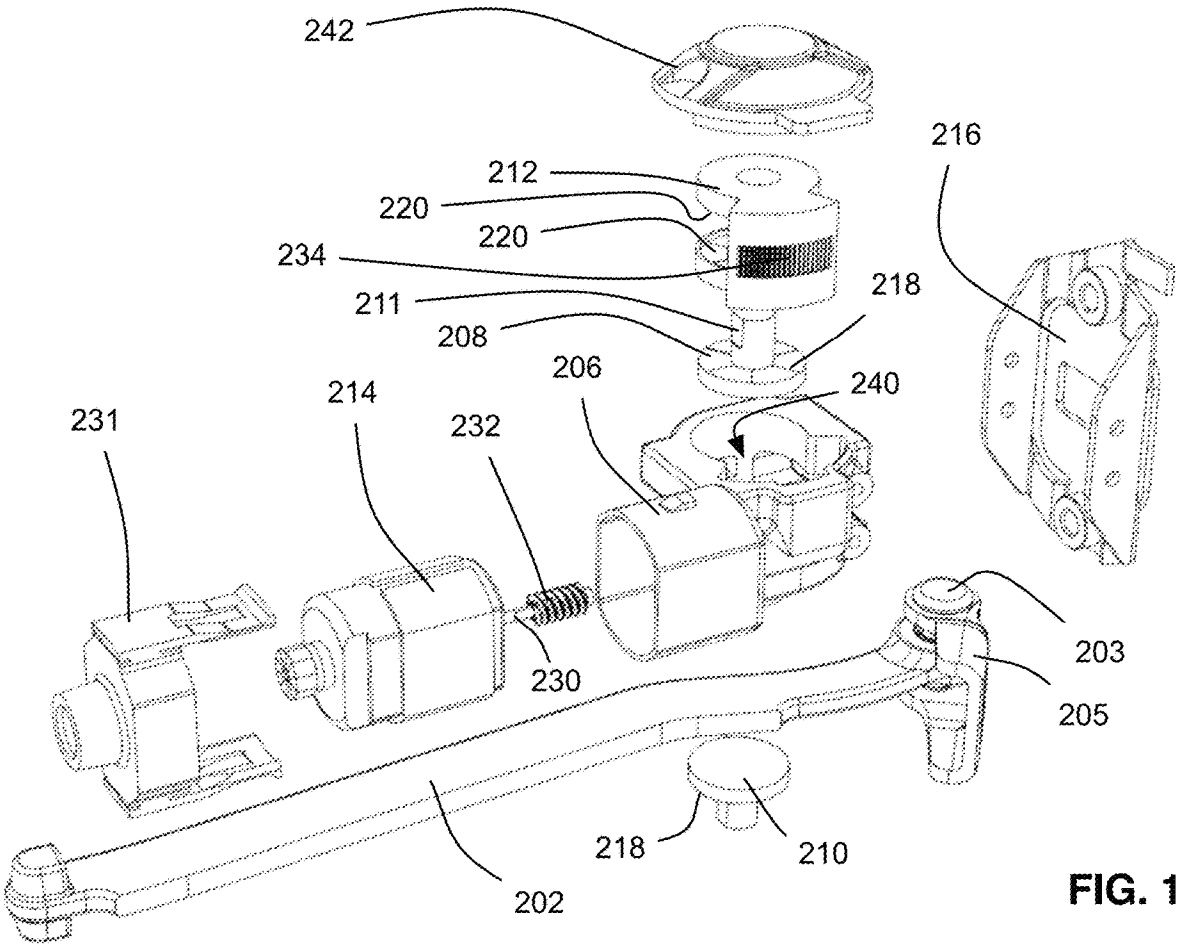
FIG. 12 is another exploded perspective view of the door control system shown in FIG. 10.

To assemble door control system 200, the assembler would place the plungers 208 and 210 into the plunger drive cam 212 and would then place that subassembly into the housing 206 through aperture shown at 240 in FIGS. 11 and 12. The assembler may then close the aperture 240 with a cap 242 that is a separate part of the housing 206. The motor 214 may be installed into the housing with the bracket 231.

It will be noted that the door control system 200 is able to accommodate a straight check arm 202, as shown, and a curved check arm 202 which may be advantageous in some embodiments.

Figure 15:
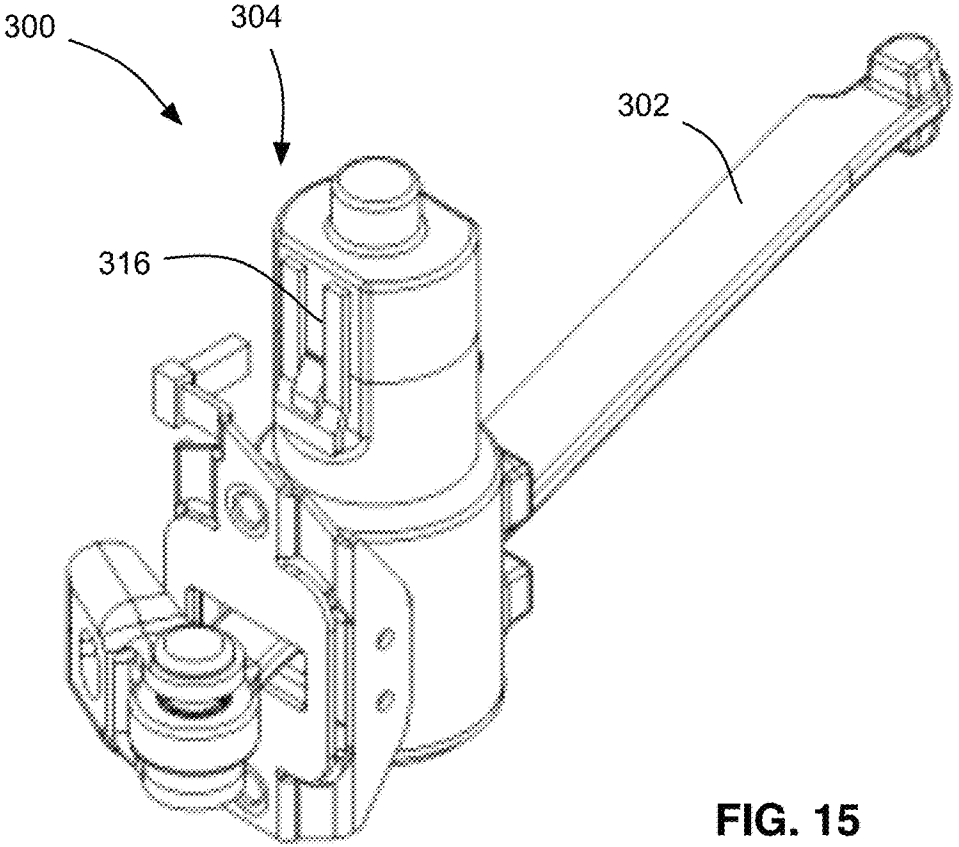
FIG. 15 is a perspective view of a door control system in accordance with another embodiment of the present disclosure.
Figure 17:
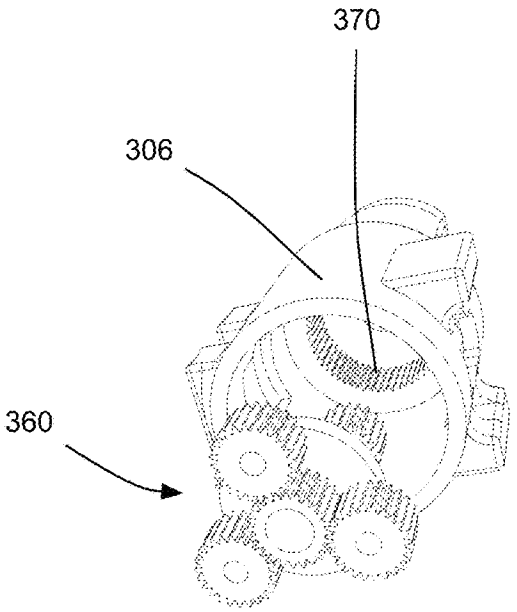
FIG. 17 is an exploded perspective view of a portion of the door control system shown in FIG. 15.
Figure 16:
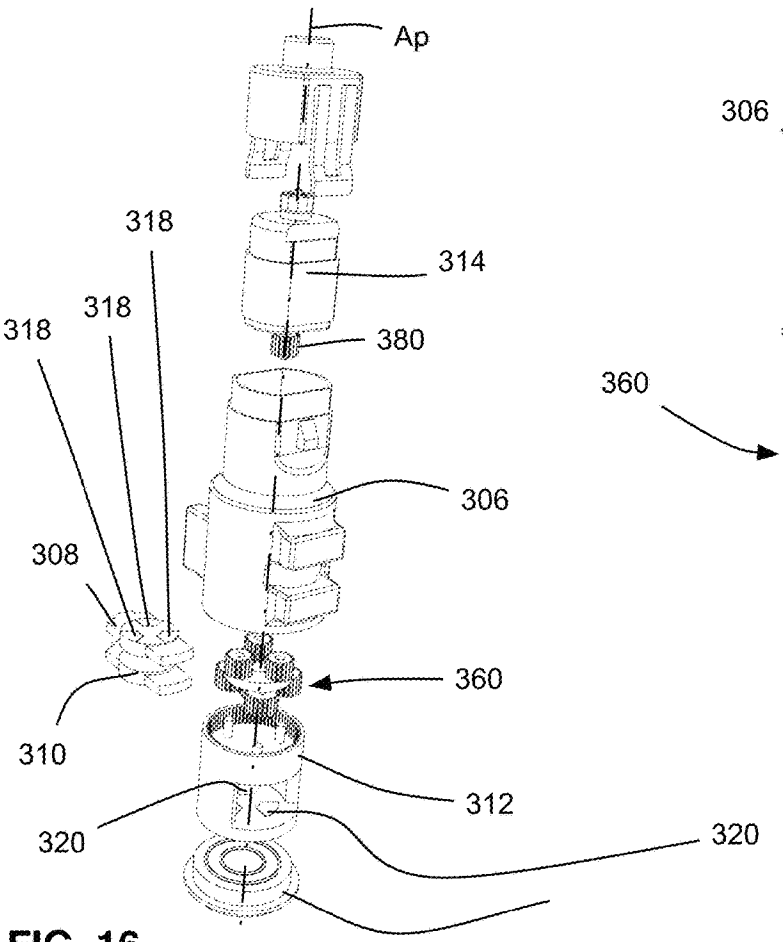
FIG. 16 is an exploded perspective view of the door control system shown in FIG. 15.
Figure 18:
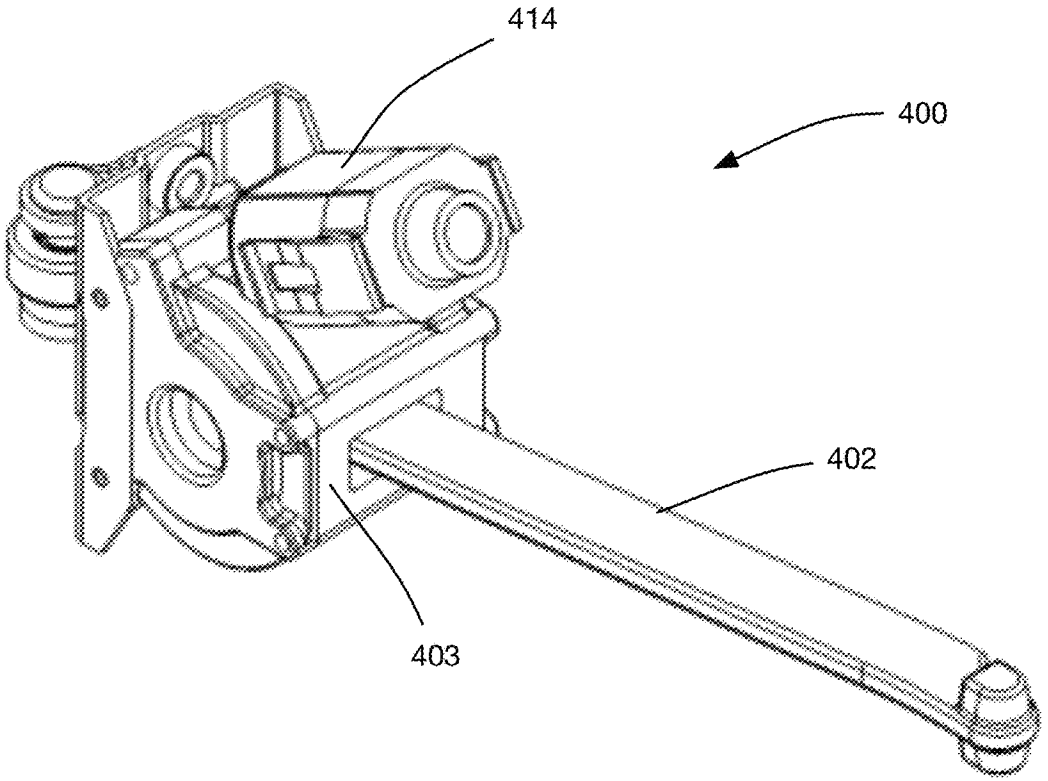
FIG. 18 is a perspective view of a door control system in accordance with another embodiment of the present disclosure.

Reference is made to FIG. 15, which shows a door control system 300 that includes a check arm 302 that is similar to the check arm 202 and a check arm keeper 304 that may be similar to the check arm keeper 204 but which includes a double planetary gear train shown at 360 between the motor shown at 314 FIG. 16) and the plunger drive cam shown at 312 that drives plungers 308 and 310 into and out of engagement with the check arm 302 in similar manner to the plungers 208 and 210 and the check arm 202. The housing shown at 306 includes a ring gear 370 that is part of the planetary gear train 360. A gear 380 on the output shaft 382 of the motor 316 is the sun gear for the planetary gear train 360.

It will be noted that the plunger cam surfaces shown at 318 and the plunger drive camming surfaces 320 are each broken into a plurality of segments, (in this example each is broken into three circumferentially spaced segments exhibiting polar symmetry). This provides a more even distribution of the axial forces on the plungers 308 and 310.

Additionally, it will be noted that the motor 314 is oriented in the same axis as the direction of movement of the plungers 308 and 310 (i.e. along the plunger axis Ap). This keeps a greater portion of the volumetric footprint of the door control system 300 near to the shut face of the door 14, which is advantageous in that it leaves a greater amount of room for other components in the regions of the door that are more commonly occupied (and which are generally not near the shut face).

Figure 19:
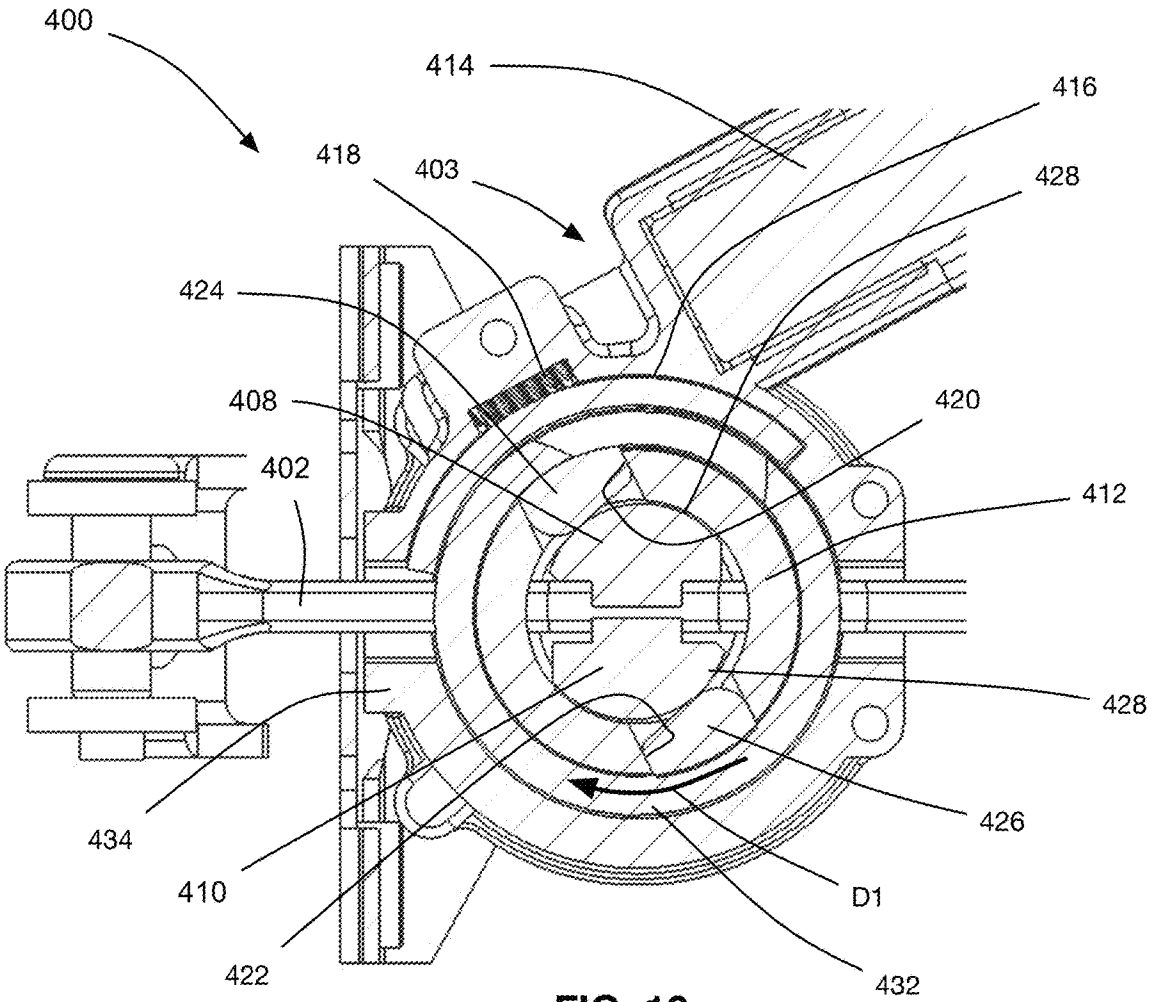
FIG. 19 is a sectional side elevation view of the door control system shown in FIG. 18.
Figure 20:
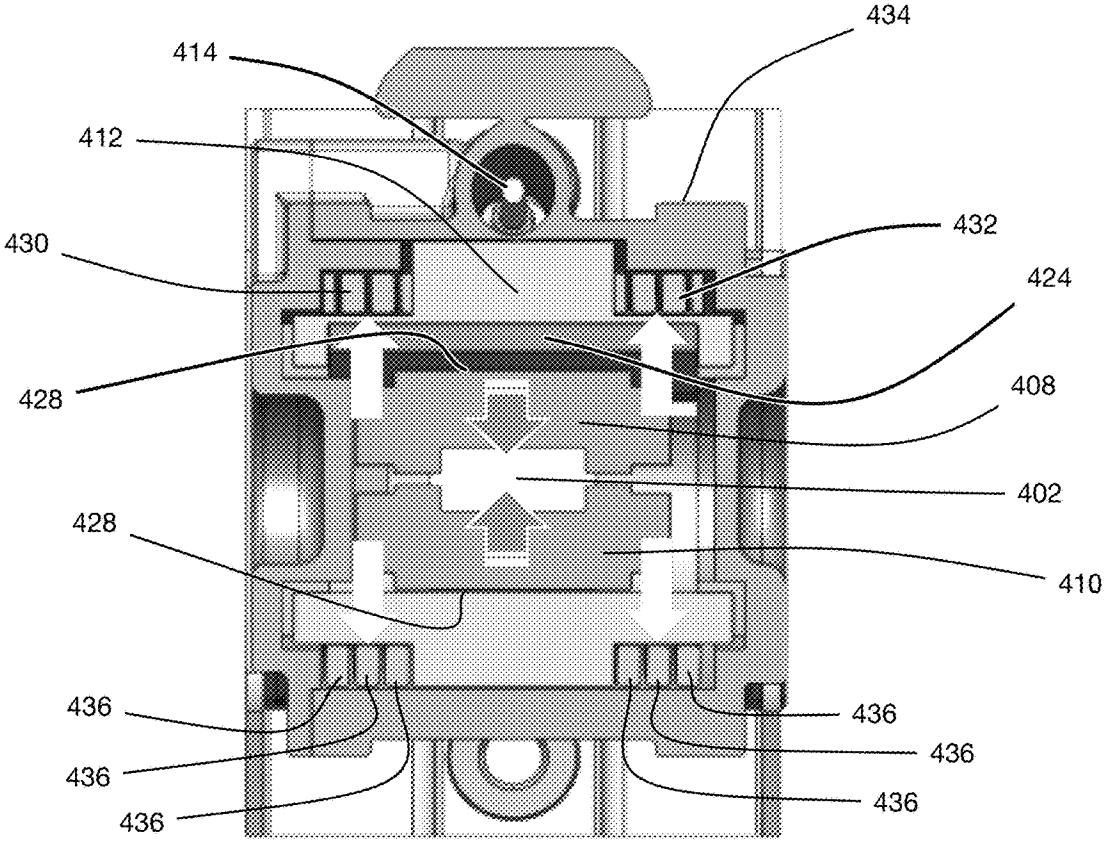
FIG. 20 is a sectional end elevation view of the door control system shown in FIG. 18.
Figure 21A:
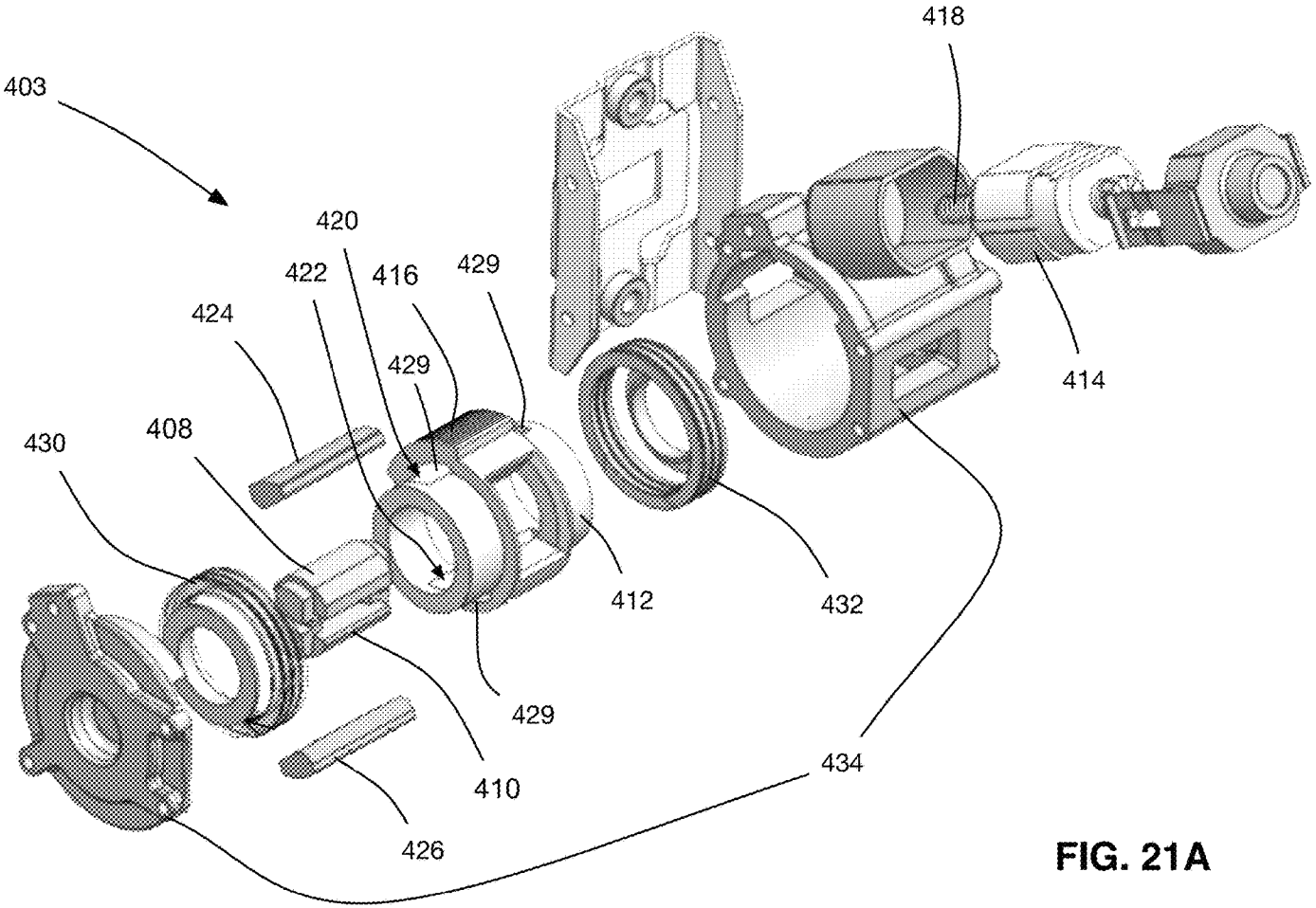
FIG. 21A is an exploded perspective view of the door control system shown in FIG. 18.
Figure 21B:
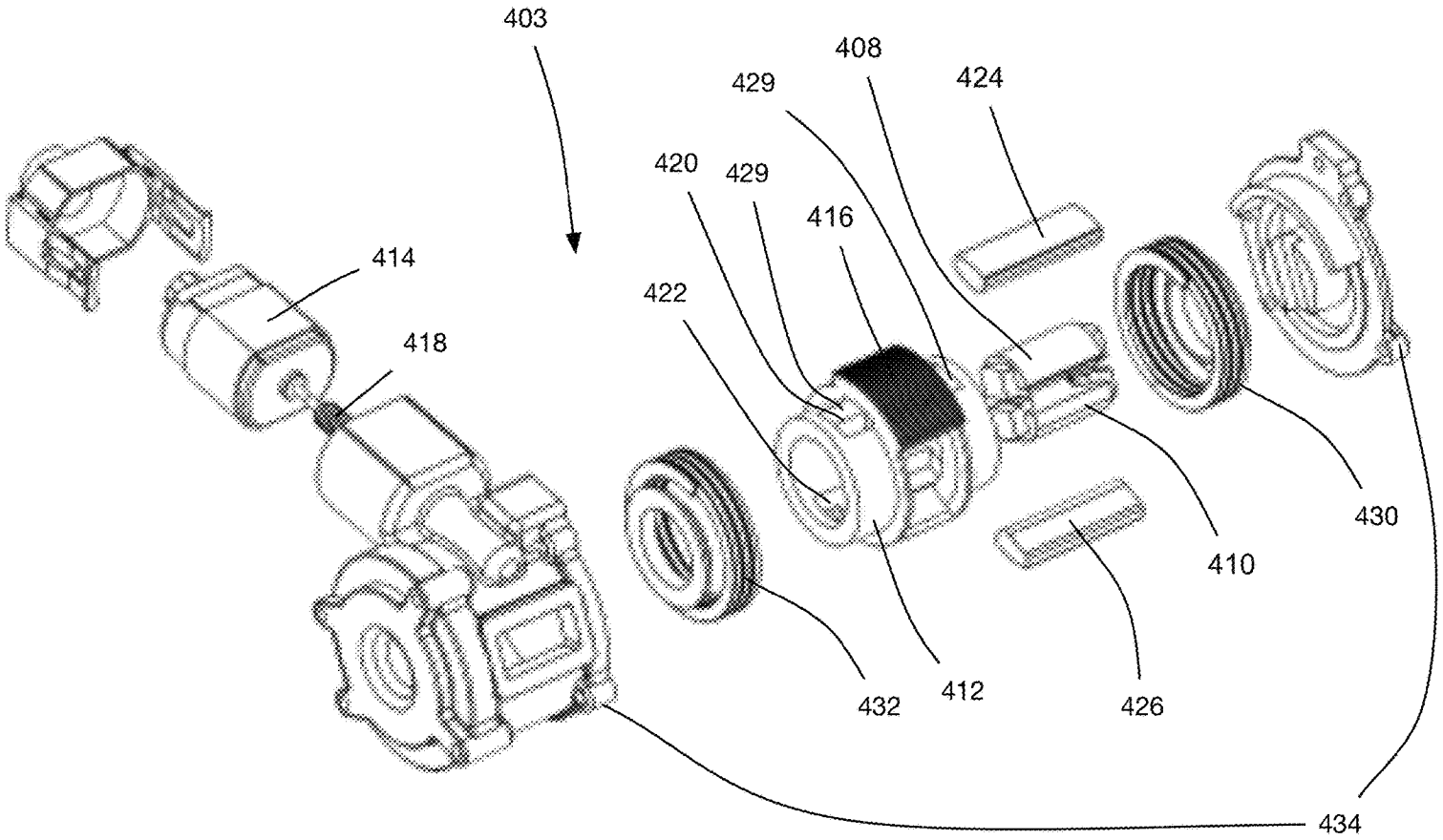
FIG. 21B is another exploded perspective view of the door control system shown in FIG. 18.
Figure 22:
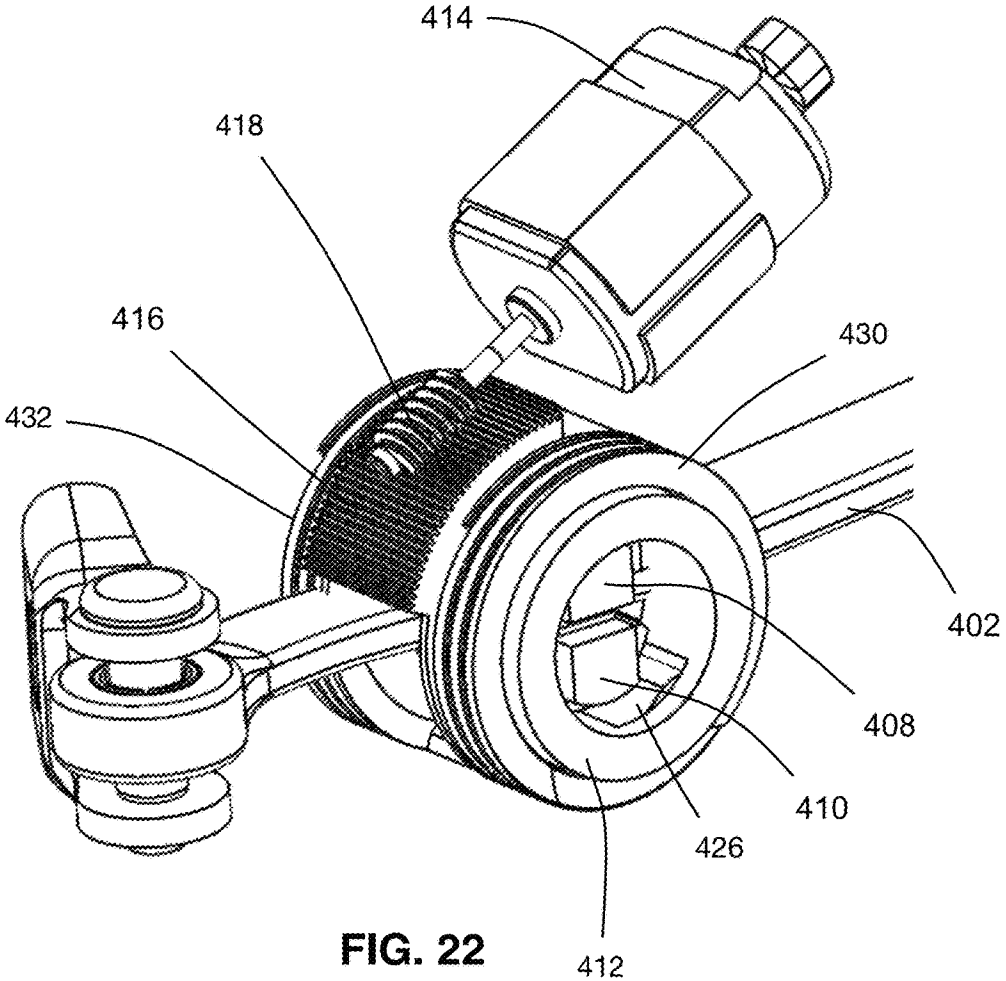
FIG. 22 is a perspective view of a portion of the door control system shown in FIG. 18.
Figure 23:
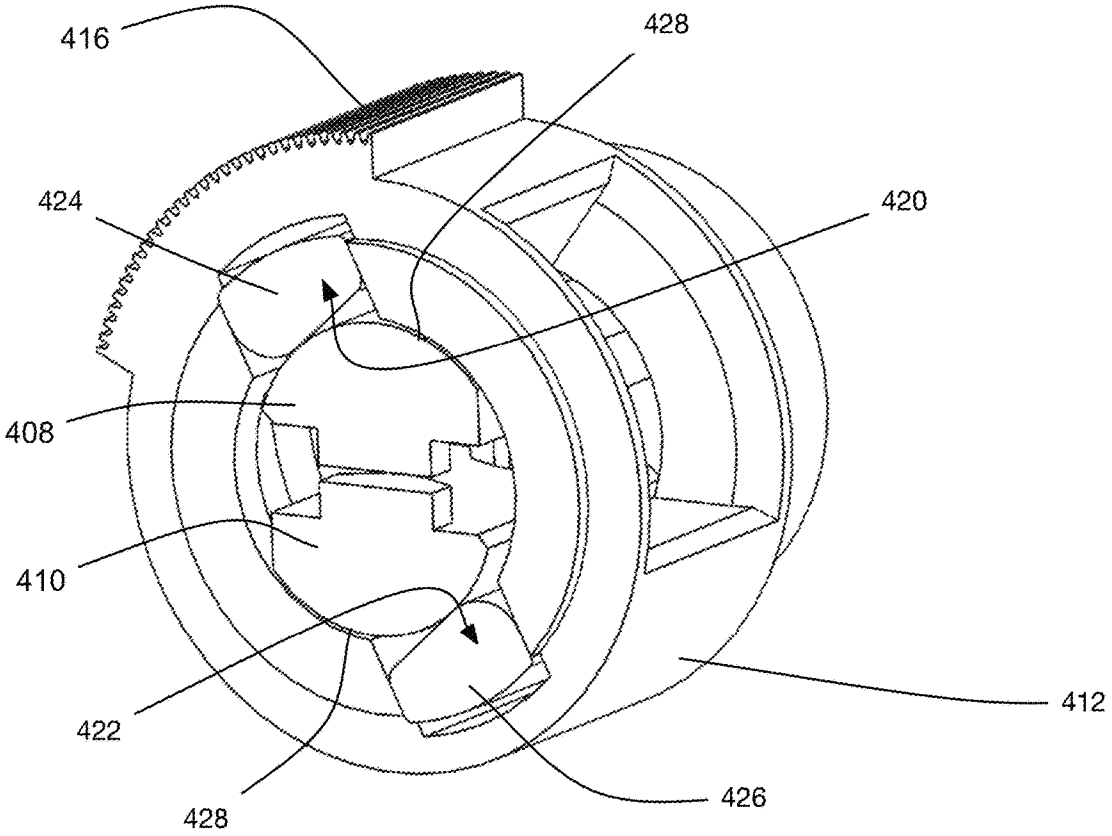
FIG. 23 is a sectional perspective view of a portion of the door control system shown in FIG. 18.

FIGS. 18-23 depict a door control system 400 in accordance with another embodiment. Referring to FIG. 19, the door control system 400 has a check arm 402, and a check arm keeper 403 employing a plunger drive cam 412 that applies a radial camming force on plungers shown at 408 and 410 when the plunger drive cam 412 undergoes rotation by a motor 414. The rotation of the plunger drive cam 412 may be provided by a sector gear 416 on the exterior of the plunger drive cam 412 that is engaged by a worm 418 that is provided on the output shaft of the motor 414. The radial camming force is applied via cam inserts 424 and 426 provided in recesses 420 and 422 in the plunger drive cam 412. As the plunger drive cam 412 is rotated by the motor 414, the cam inserts 424 and 426 slide along the outer surface 428 of each of the plungers 408 and 410. The outer surface 428 has a contour that drives the cam inserts 424 and 426 to slide outwardly in their respective recesses 420 and 422 as the plunger drive cam 412 is driven to rotate in a first direction by the motor 414 (shown by arrow D1 in FIG. 19). The recesses 420 and 422 have openings shown at 429 in FIGS. 21A and 21B. At a point in their movement outward in the recesses 420 and 422, the cam inserts 424 and 426 extend through the openings 429 and engage cam springs 430 and 432 that are mounted on the plunger drive cam 412. The cam springs 430 and 432 inhibit further outward movement of the cam inserts 424 and 426 and thereby resiliently urge the cam inserts 424 and 426 against the outer surface 428 of the plungers 408 and 410, thereby causing the plungers 408 and 410 to apply a braking force on the check arm 402. The cam springs 430 and 432 are able to expand radially by some amount before engaging the inner wall of the door control system housing shown at 434. As a result, as the plunger drive cam 412 is rotated further in the first direction D1, the cam springs 430 and 432 cause the cam inserts 424 and 426 to apply a progressively increasing force on the plungers 408 and 410 and therefore for the plungers 408 and 410 to apply a progressively increasing brake force on the check arm 402. As a result, the controller that controls the operation of the motor 414 can stop the motor 414 at a plurality of selected positions so as to cause a plurality of selected brake forces to be applied to the check arm 402.

The cam springs 430 and 432 may be coil springs, each having a plurality of coils 436 (FIG. 20) and engaging the plunger drive cam 412 on the radially inner surface of the coils 436. The inner diameter of the cam springs 430 and 432 when at rest is preferably sized to be smaller than the diameter of the outer surface of the plunger drive cam 412 on which they are mounted, so as to cause them to hold onto the outer surface of the plunger drive cam 412 with some amount of preload. Rotation of the motor in the opposite direction, so as to drive the plunger drive cam 412 in a second rotation direction that is opposite to direction D1, causes the cam inserts to engage a portion of the outer surface 428 of the plungers 408 and 410 that permits the cam inserts 424 and 426 to slide inwardly in their recesses 420 and 422. In some embodiments, the inserts 424 and 426 can slide sufficiently inwardly that the cam springs 430 and 432 do not apply any inward force on them, so that the plungers 408 and 410 can apply substantially no braking force on the check arm 402 when desired.

Figure 24:
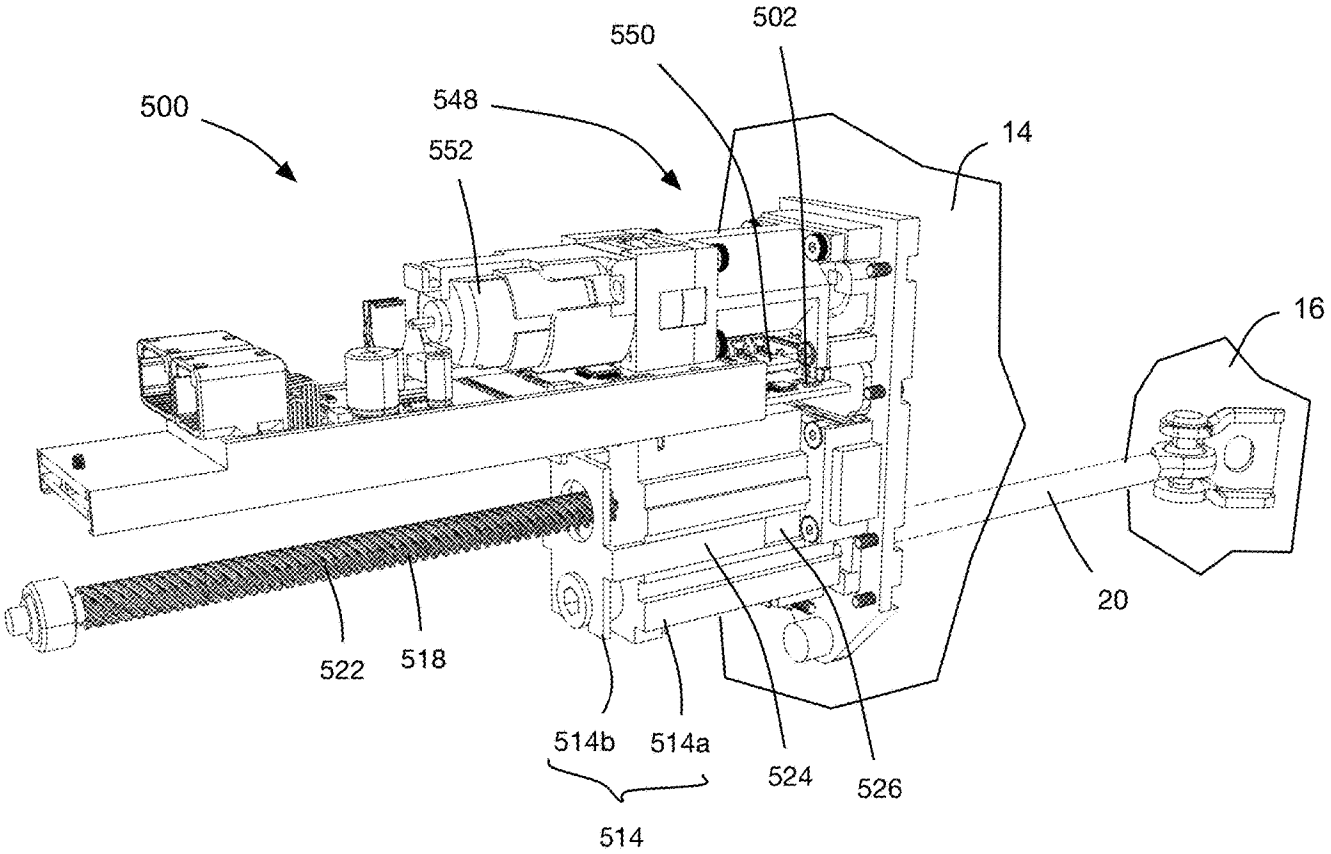
FIG. 24 is a perspective view of a door control system in accordance with another embodiment of the present disclosure.
Figure 25:
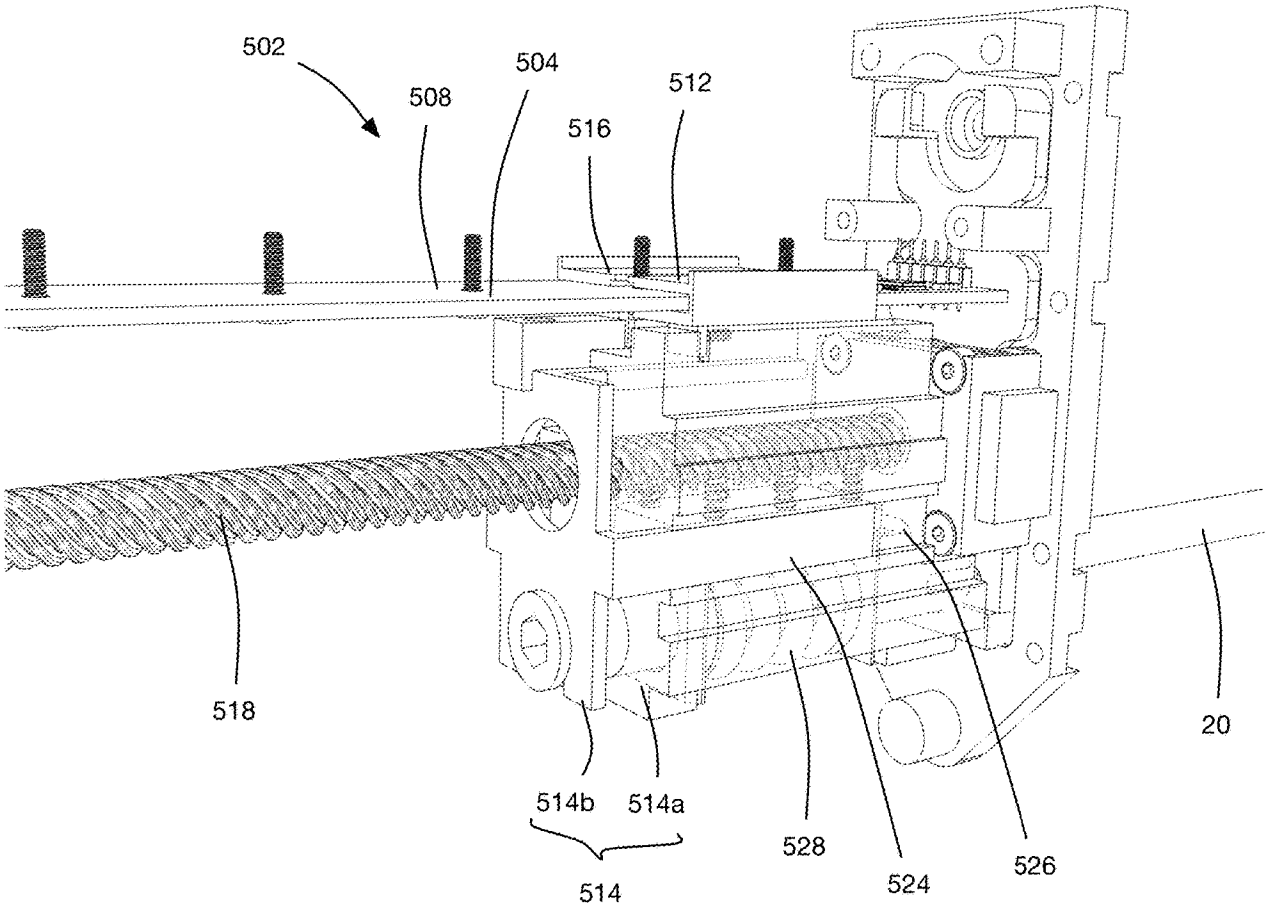
FIG. 25 is a perspective view of a portion of the door control system shown in FIG. 24 with a component shown as transparent.

Reference is made to FIG. 24 which shows a vehicle door control system 500 in accordance with another embodiment of the present disclosure. The vehicle door control system 500 may be similar to the vehicle door control system 10 shown in FIG. 2, but has a door force sensor 502 is different than the door force sensor 88 shown in FIGS. 5-8. The door force sensor 502 includes a first inductive coil arrangement 504 along a first target path 506, and a second inductive coil arrangement 508 along a second target path 510. The door force sensor 502 further includes a first conductive target 512 that is connected to a first portion 514*a* of the locking device leadscrew nut (shown 514) and is movable along the first target path 506. The door force sensor 502 further includes a second conductive target 516 that is connected to a second portion 514*b* of the locking device leadscrew nut 514 and is movable along the second target path 510.

Figure 4:
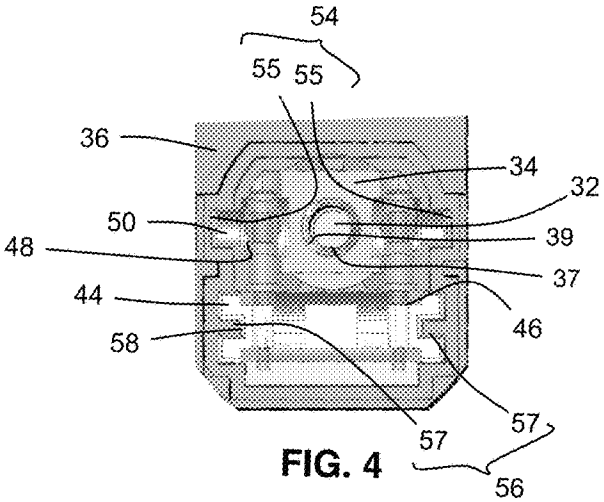
FIG. 4 is a sectional end elevation view of the vehicle door control system shown in FIG. 2.

The first portion 514*a* of the locking device leadscrew nut 514 is mounted to the locking device leadscrew (shown at 518), in the sense that the first portion 514*a* of the locking device leadscrew nut 514 has an internal leadscrew nut thread that is similar to the thread 39 (FIG. 4), and that mates with an external leadscrew thread 522 (FIG. 24) on the locking device leadscrew 518 that is similar to the thread 37 (FIG. 4). The second portion 514*b* of the locking device leadscrew nut 514 is movable relative to the first portion 514*a* of the locking device leadscrew nut 514. In the example shown, the second portion 514*b* has slider arms 524 that are slidably mounted in slider arm slots 526 in the first portion 514*a*.

Figure 26:
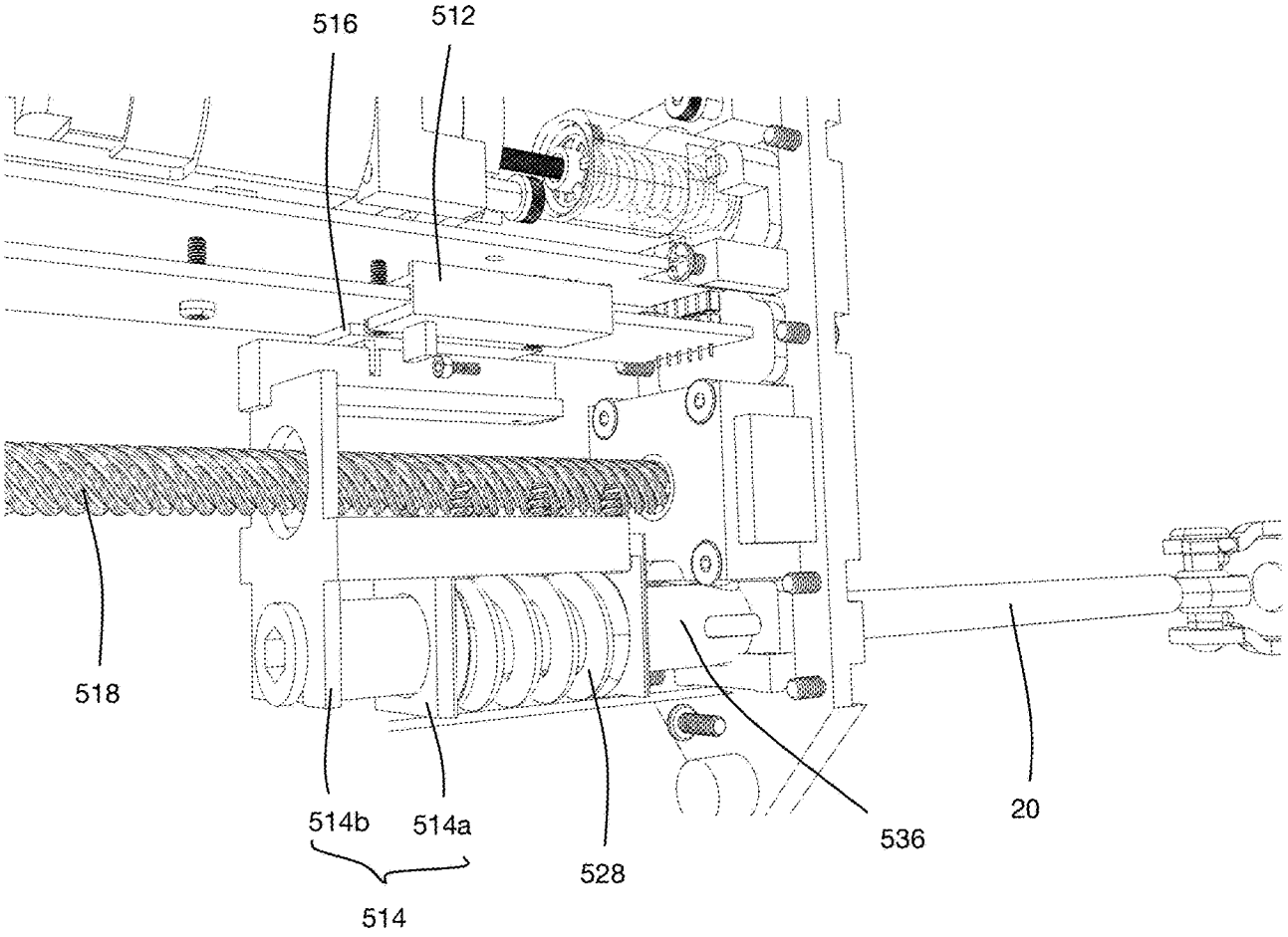
FIG. 26 is another perspective view of a portion of the door control system shown in FIG. 24.
Figure 27:
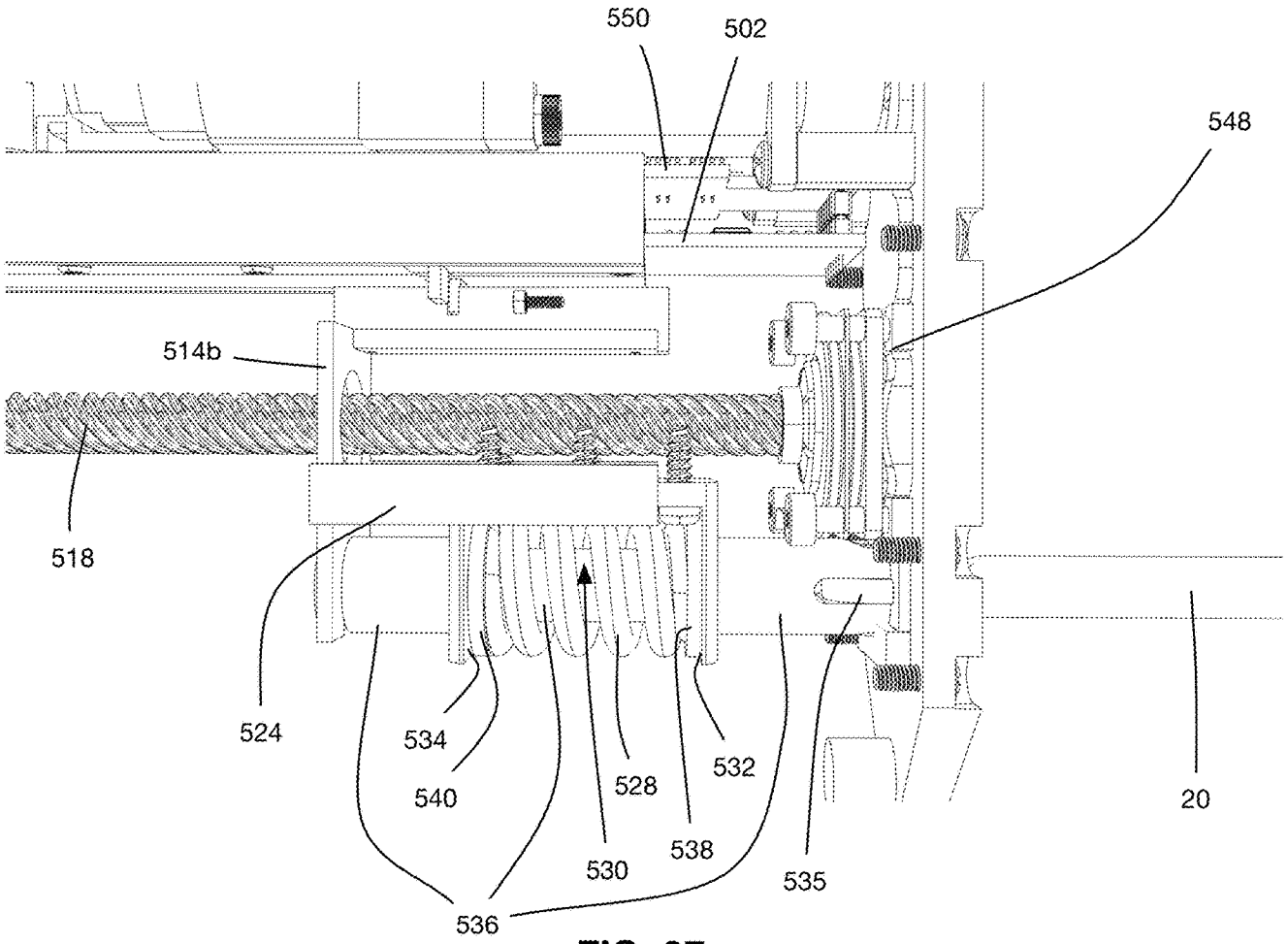
FIG. 27 is another perspective view of a portion of the door control system shown in FIG. 24.

With reference to FIGS. 25-36, the second portion 514*b* of the locking device leadscrew nut 514 is operatively connected to the first portion 514*a* of the locking device leadscrew nut 514 via a leadscrew nut spring 528. In FIGS. 25 and 28-30, a main body of the first portion 514*a* of the locking device leadscrew nut 514 is shown in transparent form so as to show elements contained therewithin. In FIGS. 26 and 27 the aforementioned main body is removed entirely for greater clarity.

Figure 33:
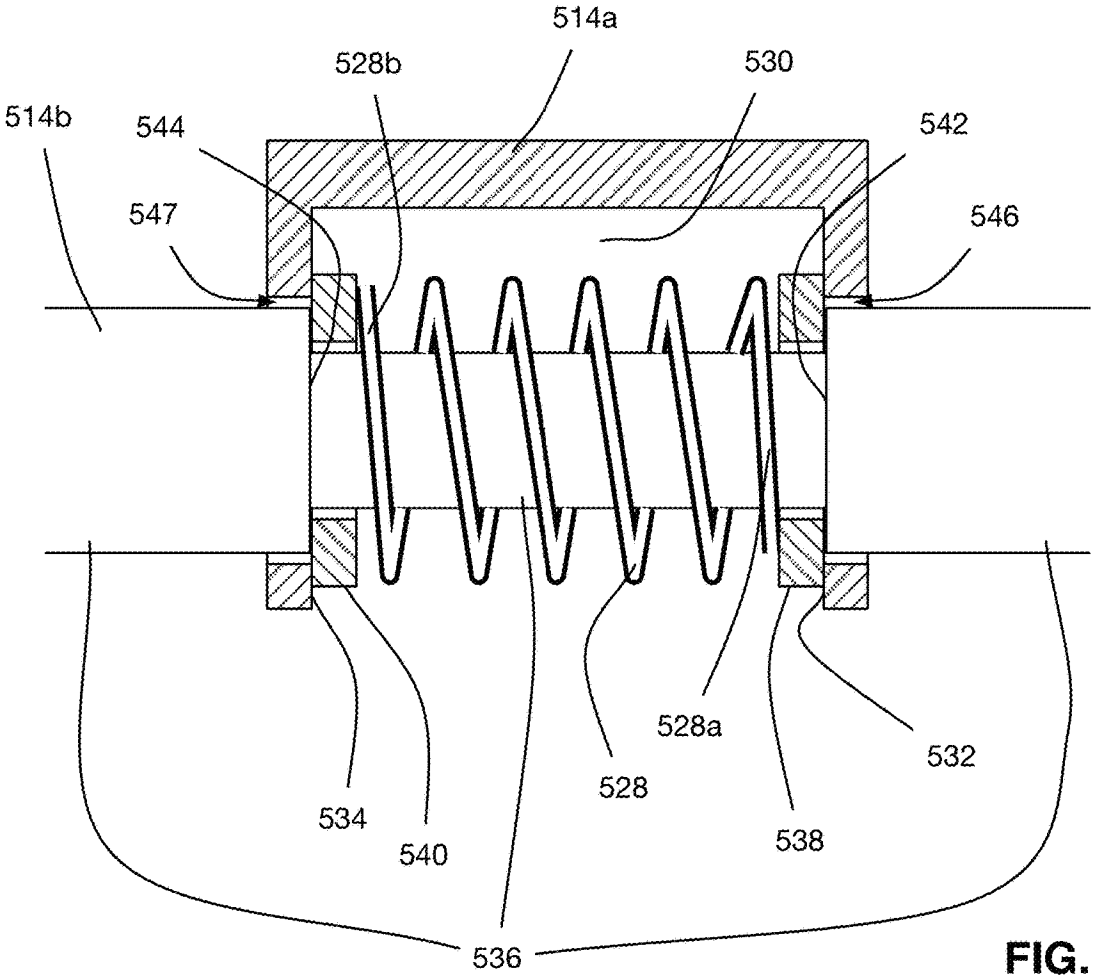
FIG. 33 is a sectional side view of a portion of a leadscrew nut that is part of the door control system shown in FIG. 24, when no initiation force is applied to the vehicle door.

The operation and mounting of the leadscrew nut spring 528 is described further below. the first portion 514*a* of the locking device leadscrew nut 514 includes a spring recess 530 (best seen in FIG. 33) having a first end wall 532 and a second end wall 534. The second end 40 (FIG. 27) of the pushrod 20 is connected (e.g. pivotally connected via a pivot connection 535 shown in FIG. 27) to a pass-through shaft 536 (FIG. 33) that is part of the second portion 514*b* (FIG. 27) of the locking device leadscrew nut 514, and that passes through the spring recess 530 (FIG. 33). A first end plate 538 is slidable on the pass-through shaft 536. A second end plate 540 is also slidable on the pass-through shaft 536. The leadscrew nut spring 528 may be a helical compression spring that surrounds the pass-through shaft 536 and has a first spring end 528*a* that abuts the first end plate 538 and a second spring end 528*b* that abuts the second end plate 540. The leadscrew nut spring 528 may be sized to urge the first and second end plates 538 and 540 against the first and second end walls 532 and 534. In other words, the leadscrew nut spring 528 may have some compressive preload at all positions. The pass-through shaft 536 has first and second driver faces 542 and 544, which can pass through first and second wall apertures 546 and 547 respectively, in the first and second end walls 532 and 534.

Figure 28:
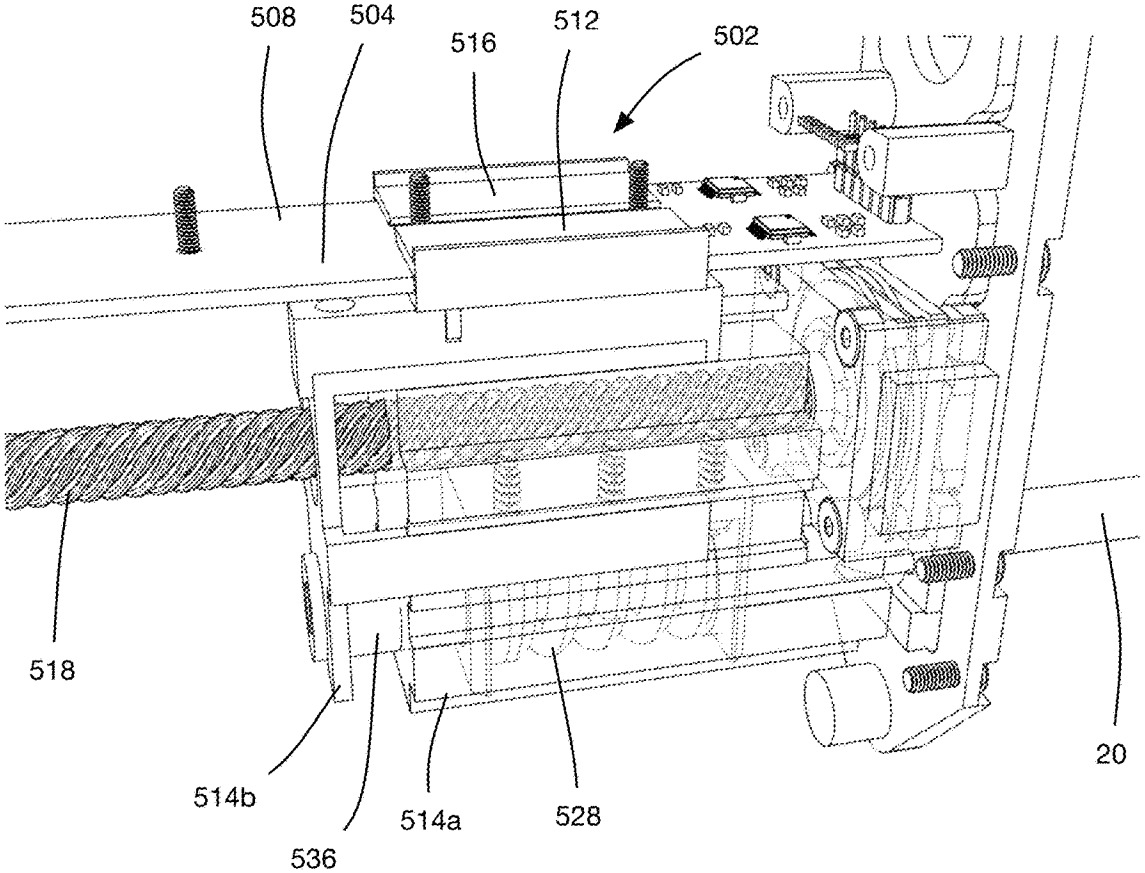
FIG. 28 is another perspective view of a portion of the door control system shown in FIG. 24, showing first and second sensor targets when no initiation force is applied to the vehicle door.
Figure 31:
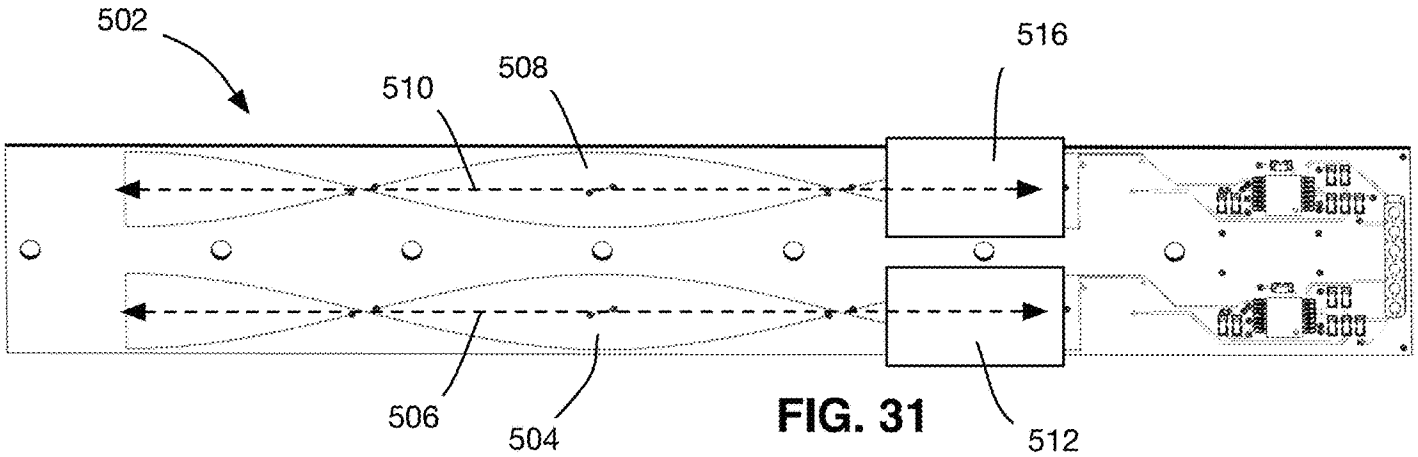
FIG. 31 is a plan view of a door force sensor that is part of the door control system shown in FIG. 24, when no initiation force is applied to the vehicle door.

FIG. 31 shows the positions of the first and second conductive targets 512 and 516 on the first and second inductive coil arrangements 504 and 508 when the locking device leadscrew nut 514 is in the position shown in FIGS. 27 and 28.

Figure 32:
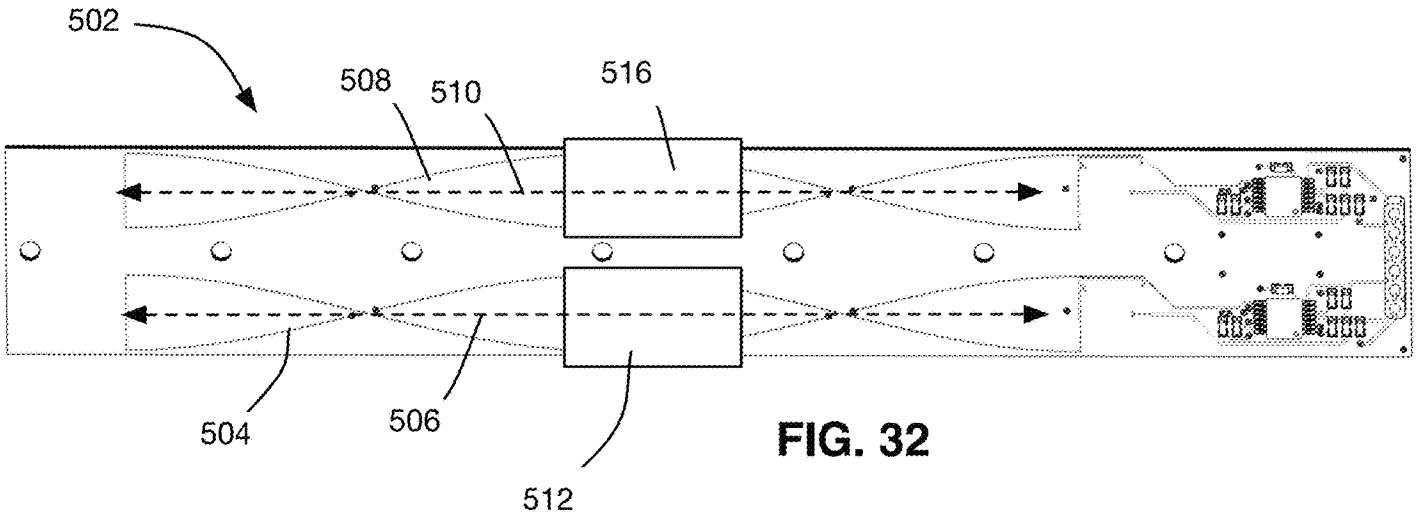
FIG. 32 is a plan view of the door force sensor shown in FIG. 31, when the vehicle door is moved to a new position.

During movement of the pushrod 20 in a first direction when the locking device leadscrew brake, shown at 548, is in the release position, the pushrod 20 drives the pass-through shaft 536 in a first direction, which is towards the left in the view shown in FIGS. 27 and 28. This, in turn, causes the first driver face 542 (FIG. 33) to drive the first end plate 538 towards the second end plate 540, which transfers a force into the first spring end 528*a* of the leadscrew nut spring 528. The force is then transferred through the leadscrew nut spring 528 and from the second spring end 528*b* into the second end plate 540 (and therefore into the second end wall 534). Because the pass-through shaft 536 is part of the second portion 514*b* of the locking member leadscrew nut 514, the second portion 514*b* is driven towards the left. Because of the force transferred through the leadscrew nut spring 528 into the first portion 514*a* of the locking member leadscrew nut 514, the first portion 514*a* of the locking member leadscrew nut 514 is also driven towards the left, if the locking device leadscrew brake 548 (FIG. 27) is in the release position. Such movement of the locking member leadscrew nut 514 affects the first and second conductive targets 512 and 516 as illustrated in FIG. 32, where the first and second conductive targets 512 and 516 are both moved to the left of their positions shown in FIG. 31.

The position of the first conductive target 512 (FIG. 31) may be used to determine the position of the vehicle door 16 (FIG. 24). More particularly, the door force sensor 502 may be connected to the controller 550 so as to send signals to the controller 550 that are indicative of the position of the first conductive target 512. Because the first conductive target 512 is connected for movement with the first portion 514*a* of the locking device leadscrew nut 514, the position of the first conductive target 512 is determinative of the position of the pushrod 20 and therefore of the vehicle door 16. Additionally, by detecting the rate of change in the position of the first conductive target 512, the controller 550 can determine the speed of the door 16 during movement thereof.

Figure 29:
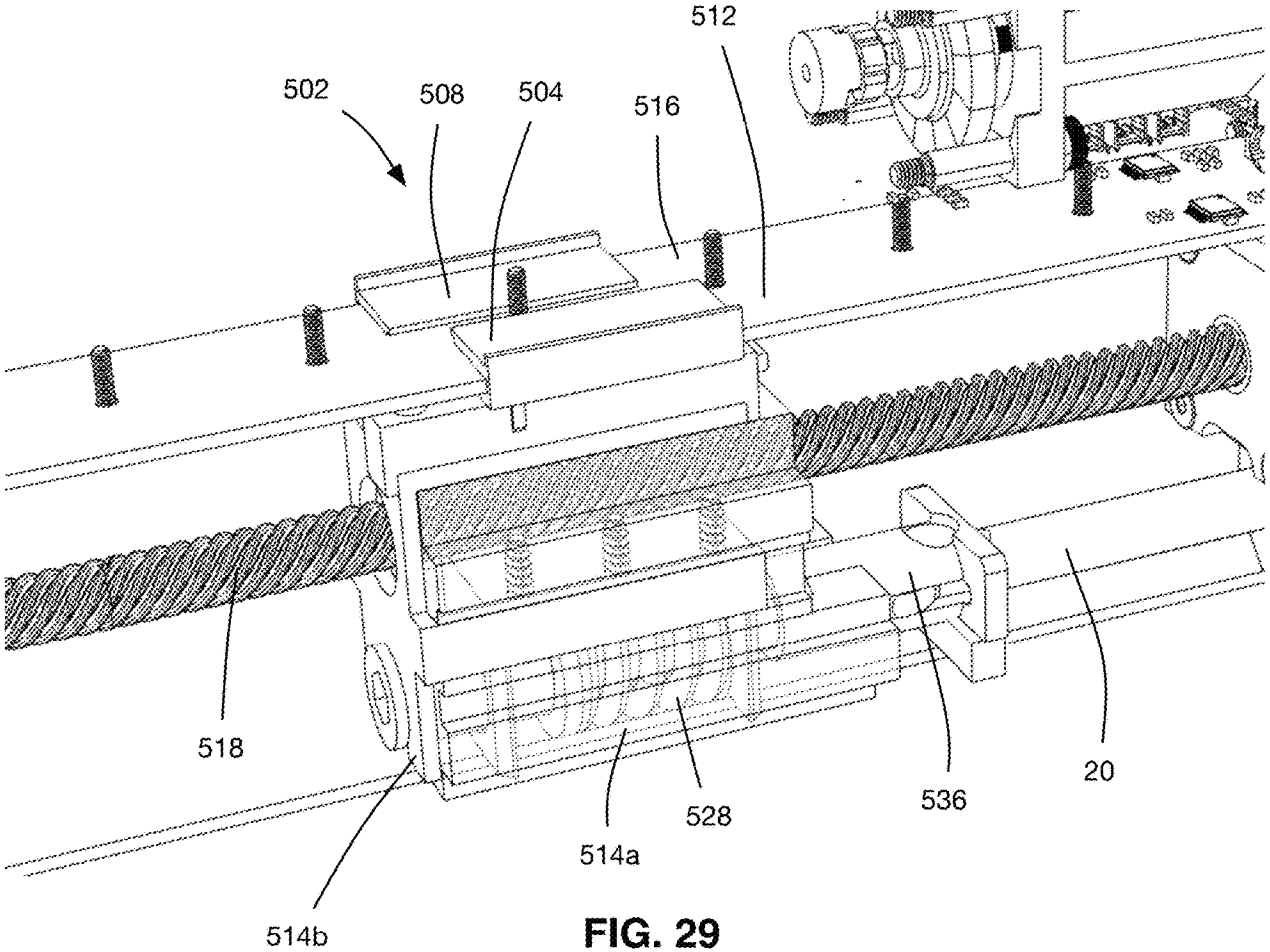
FIG. 29 is another perspective view of a portion of the door control system shown in FIG. 24, showing the first and second sensor targets when an initiation force is applied to the vehicle door in a first direction while the door is held in a selected position by the door control system.
Figure 34:
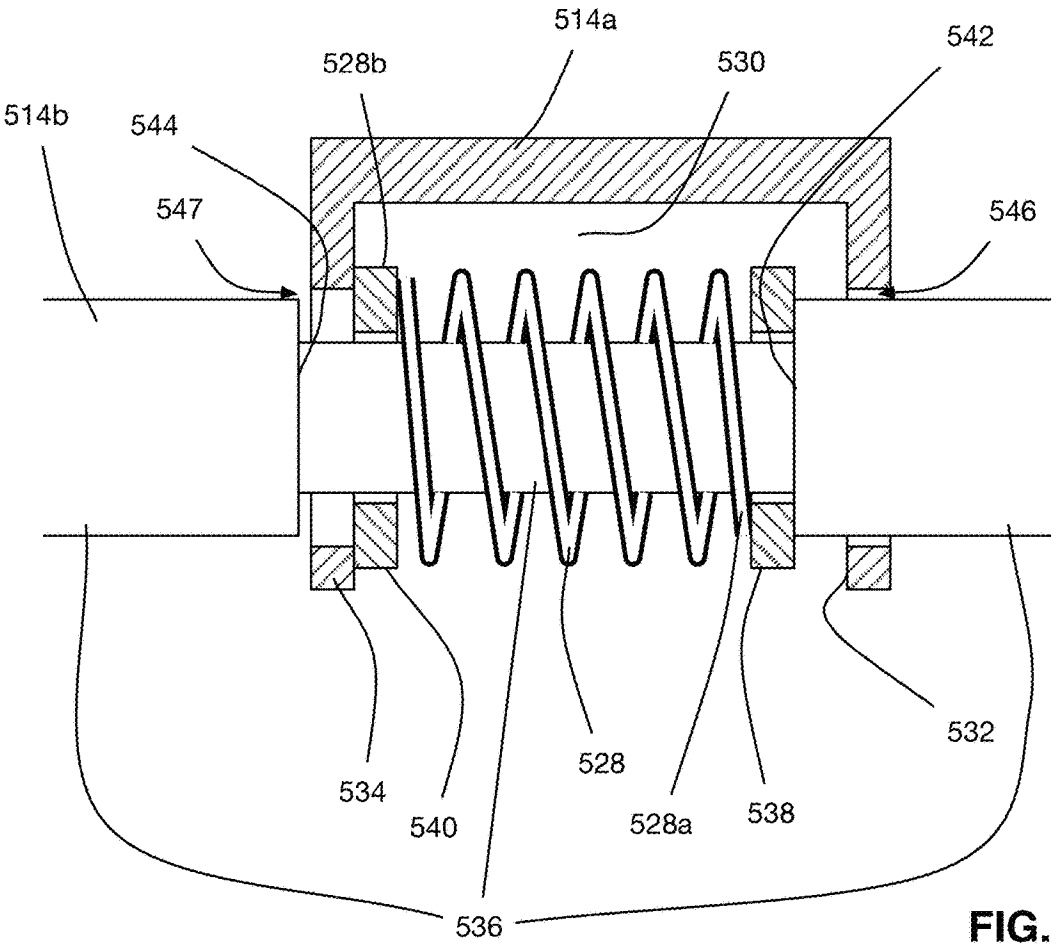
FIG. 34 is a sectional side view of the portion of the leadscrew nut shown in FIG. 33, when an initiation force is applied to the vehicle door in the first direction while the door is held in a selected position by the door control system.

When the locking device leadscrew brake 548 is in the braking position, then the leadscrew 518 is prevented from turning, which prevents movement of the first portion 514*a* of the locking device leadscrew nut 514. As a result, when a user applies an initiation force to move the vehicle door 16, the second portion 514*b* of the locking device leadscrew nut 514 will move, but the first portion 514*a* of the locking device leadscrew nut 514 remains stationary. This situation is illustrated in FIGS. 29 and 34. The first driver face 542 is positioned to drive the first end plate 538 towards the second end plate 540, which transfers a force into the first spring end 528*a* of the leadscrew nut spring 528. However, because the first portion 514*a* of the locking device leadscrew nut 514 is locked, the leadscrew nut spring 528 flexes (e.g. compresses in the embodiment shown) instead of driving movement of the first portion 514*a* of the locking device leadscrew nut 514. The amount of movement that occurs is based on the initiation force applied by the user and the spring rate of the leadscrew nut spring 528. Because the second conductive target 516 is connected for movement with the second portion 514*b* of the locking device leadscrew nut 514, there will be movement in the second conductive target 516 but not the first conductive target 512 (i.e. relative movement between the first and second conductive targets 512 and 516), as can be seen in FIG. 29.

Figure 30:
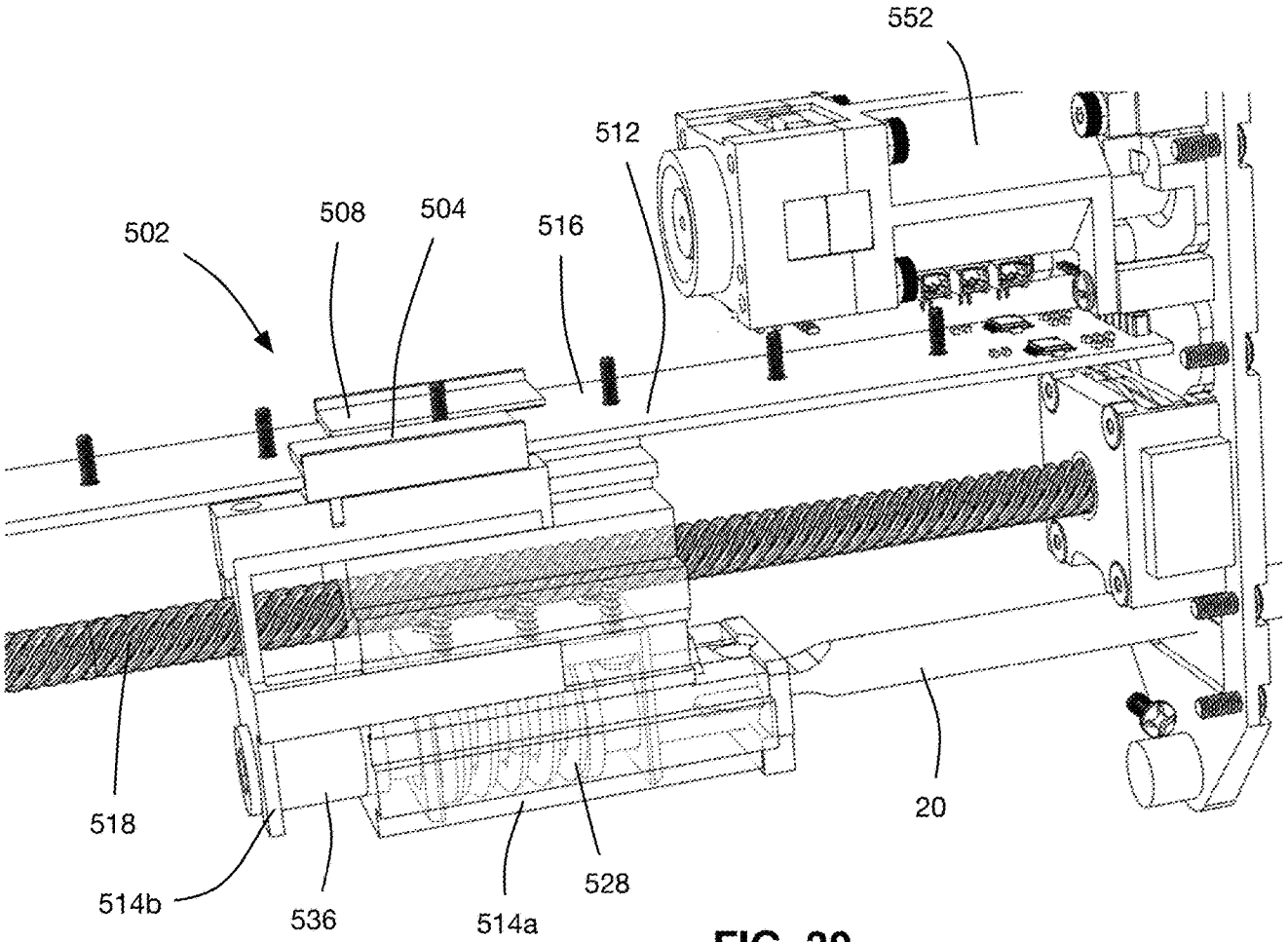
FIG. 30 is another perspective view of a portion of the door control system shown in FIG. 24, showing the first and second sensor targets when an initiation force is applied to the vehicle door in a second direction while the door is held in the selected position by the door control system.
Figure 35:
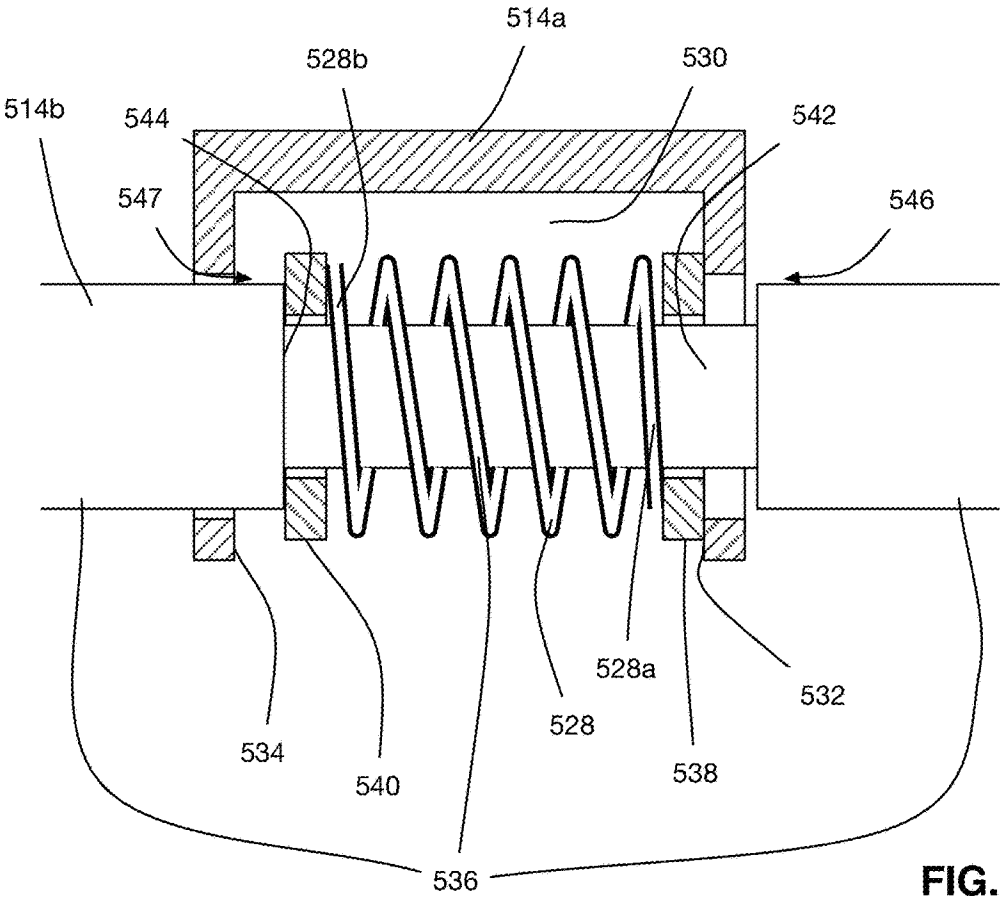
FIG. 35 is a sectional side view of the portion of the leadscrew nut shown in FIG. 33, when an initiation force is applied to the vehicle door in the second direction while the door is held in a selected position by the door control system.

FIG. 30 shows the resulting relative movement of the second conductive target 516 relative to the first conductive target 512 when the user applies an initiation force to drive the pushrod 20 in a second direction while the locking device leadscrew brake 548 is in the braking position. During such an event, the second driver face 544 is positioned to drive the second end plate 540 towards the first end plate 538, which transfers a force into the second spring end 528*b* of the leadscrew nut spring 528 (FIG. 35). However, because the first portion 514*a* of the locking device leadscrew nut 514 is locked, the leadscrew nut spring 528 flexes (e.g. compresses in the embodiment shown) instead of driving movement of the first portion 514*a* of the locking device leadscrew nut 514.

The door force sensor 502 (FIG. 28) is connected to the controller 550 so as to send signals to the controller 550 that are indicative of the positions of the first and second conductive targets 512 and 516. The controller 550 is programmed to control operation of the motor shown at 552 based at least in part on a difference in the positions of the first and second conductive targets 512 and 516 relative to one another. As will be understood, the difference in positions between the first and second conductive targets 512 and 516 is related to the force applied on the vehicle door 16 away from the position it is being held in by the locking device leadscrew brake 548. The controller 550, upon determining the force being applied to the door 16, can control operation of the motor 552, in a similar manner to the controller 68 when controlling the motor 62. If the controller 550 determines that the user has applied a sufficiently high initiation force, the controller 550 may command the motor 552 to reduce (optionally reduce to zero) the check force on the door 16.

The components shown in FIGS. 24-30 that have the same name as the components shown in FIGS. 2-9 may be interpreted as being similar to those components in FIGS. 2-9, except for any differences described herein. Thus, for example, it will be understood that the locking device leadscrew brake 548 may be similar to the brake 38 shown in FIGS. 5 and 6, and may therefore include a clutch pack shown at 554, the motor 552, a clutch pack compression member 556 that is movable by the motor 552 to selectively compress the clutch pack 554 to prevent rotation of the locking device leadscrew 518, and the controller 550.

While the door force sensor 502 has been described as being an inductive sensor that includes conductive targets, it will be noted that the force sensor 502 could include any other suitable structure with first and second targets that move along first and second target paths such that their relative movement is detected by a controller in order to determine the initiation force applied by to a vehicle door, or more broadly, in order to determine whether the initiation force exceeds a selected threshold force so as to control a motor that is operable to move a locking device brake between braking and release positions. Furthermore, the locking device shown and described in relation to FIGS. 24-35 need not incorporate a leadscrew and leadscrew nut, but could alternatively incorporate any suitable structure where the leadscrew nut is more broadly any suitable traveler that is movable by the pushrod 20, wherein the locking device brake prevents movement of the traveler, and wherein the traveler is made up of first and second portions that are movable relative to one another and are connected via a traveler spring. Furthermore, the locking device brake may be any suitable type of brake and need not include a clutch pack.

Thus, it can be seen that the door force sensor 502 provides the capability to determine the position of the vehicle door 16, the speed of the door 16 during movement thereof, and the capability to determine the initiation force applied by the user to the door 16.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A vehicle door control system for a vehicle having a vehicle body and a vehicle door, comprising:

a housing;

a pushrod having a first end that is connected to one of the vehicle body and the vehicle door; and a locking device at least a portion of which is mounted to the other of the vehicle body and the vehicle door, wherein the locking device includes a locking device leadscrew, a locking device leadscrew nut mounted on the locking device leadscrew, a locking device housing including a locking device leadscrew nut guide path, and a locking device leadscrew brake, wherein the pushrod has a second end that is connected to the locking device leadscrew nut, wherein the locking device leadscrew nut is constrained against rotation but is slideable along the locking device leadscrew nut guide path by movement of the pushrod, which causes rotation of the locking device leadscrew, wherein the locking device leadscrew brake is positionable in a braking position in which the locking device leadscrew brake prevents rotation of the locking device leadscrew, and a release position in which the locking device leadscrew brake permits rotation of the locking device leadscrew, wherein the locking device leadscrew brake includes:

a plurality of plates which are interleaved with a plurality of discs, wherein the plurality of plates are non-rotatable relative to the housing but are translatable relative to the housing, wherein the plurality of discs are connected to the leadscrew, and a motor having a motor output shaft, wherein the motor output shaft is rotatable in a first direction to increase compression of the plates and the discs so as to increase a frictional force that prevents rotation of the leadscrew, and wherein the motor output shaft is rotatable in the second direction to reduce compression of the plates and the discs, so as to decrease the frictional force that prevents rotation of the leadscrew, wherein the motor is controllable to modulate the frictional force that prevents rotation of the leadscrew.

2. A vehicle door control system as claimed in claim 1, wherein the locking device leadscrew brake further includes a clutch pack compression member that is movable by the motor to selectively compress the plates and discs which prevents rotation of the locking device leadscrew.

3. A vehicle door control system as claimed in claim 2, wherein the motor is operatively connected to a motor leadscrew, wherein the motor leadscrew has a motor leadscrew nut thereon, wherein the locking device housing includes a motor leadscrew nut guide path, wherein the motor leadscrew nut is constrained against rotation but is slideable along the motor leadscrew nut guide path by rotation of the motor, wherein the motor leadscrew nut is operatively connected to the clutch pack compression member, thereby operatively connecting the motor to the clutch pack compression member.

4. A vehicle door control system as claimed in claim 3, further comprising a controller that controls operation of the motor.

5. A vehicle door control system as claimed in claim 4, further comprising a door movement sensor positioned to detect movement of the door, wherein the controller is programmed to receive signals from the door movement sensor indicative of door movement.

6. A vehicle door control system as claimed in claim 5, wherein the door movement sensor is positioned to detect rotation of the leadscrew.

7. A vehicle door control system as claimed in claim 6, further comprising a door force sensor positioned to send signals to the controller indicative of the position of the locking device leadscrew brake.

8. A vehicle door control system as claimed in claim 7, further comprising at least one spring operatively connected between the locking device leadscrew and a leadscrew output member, wherein the leadscrew output member is connected to the clutch pack.

9. A vehicle door control system as claimed in claim 4, further comprising a door force sensor that includes a first target path, and a second target path, and a first target that is connected to a first portion of the locking device leadscrew nut and movable along the first target path and a second target that is connected to a second portion of the locking device leadscrew nut and movable along the second target path, wherein the first portion of the locking device leadscrew nut is mounted to the locking device leadscrew and the second portion of the locking device leadscrew nut is movable relative to the first portion of the locking device leadscrew nut and is operatively connected to the first portion of the locking device leadscrew nut via a leadscrew nut spring, wherein the second end of the pushrod is connected to the second portion of the locking device leadscrew nut, wherein the first target is connected for movement with the first portion of the locking device leadscrew nut and wherein the second target is connected for movement with the second portion of the locking device leadscrew nut, wherein, when the locking device leadscrew brake is positioned in the braking position, movement of the vehicle door drives relative movement between the first portion of the locking device leadscrew nut and the second portion of the locking device leadscrew nut via the pushrod, so as to generate relative movement between the first target and the second target, and wherein the door force sensor is connected to the controller so as to send signals to the controller that are indicative of the positions of the first and second targets, and wherein the controller is programmed to control operation of the motor based at least in part on a difference in the positions of the first and second targets relative to one another.

10. A vehicle door control system as claimed in claim 9, further comprising a door force sensor that includes a first inductive coil arrangement along the first target path, and a second inductive coil arrangement along the second target path, and wherein the first target is a first conductive target and wherein the second target is a second conductive target.

11. A vehicle door control system as claimed in claim 1, wherein the pushrod is pivotally connected to the leadscrew nut and to said one of the vehicle body and the vehicle door.

* * * * *